US008113947B2

(12) United States Patent
Hornik et al.

(10) Patent No.: US 8,113,947 B2
(45) Date of Patent: Feb. 14, 2012

(54) WAGERING GAME WITH AWARD UNLOCKING FEATURE

(75) Inventors: Jeremy M. Hornik, Chicago, IL (US); Matthew J. Ward, Northbrook, IL (US); Peter W. Flemming, Chicago, IL (US); Michael P. Casey, Las Vegas, NV (US)

(73) Assignee: WMS Gaming Inc., Waukegan, IL (US)

( * ) Notice: Subject to any disclaimer, the term of this patent is extended or adjusted under 35 U.S.C. 154(b) by 1456 days.

(21) Appl. No.: 11/242,466

(22) Filed: Oct. 3, 2005

(65) Prior Publication Data

US 2006/0111169 A1 May 25, 2006

Related U.S. Application Data

(60) Provisional application No. 60/615,461, filed on Oct. 1, 2004.

(51) Int. Cl.
*A63F 9/24* (2006.01)

(52) U.S. Cl. ..... 463/25

(58) Field of Classification Search ..... 463/16–22, 463/29, 25

See application file for complete search history.

(56) References Cited

U.S. PATENT DOCUMENTS

| | | | | |
|---|---|---|---|---|
| 4,323,249 A * | 4/1982 | Brady | 273/249 |
| 4,624,459 A | 11/1986 | Kaufman | 273/143 R |
| 4,752,068 A | 6/1988 | Endo | |
| 4,837,728 A | 6/1989 | Barrie et al. | 364/412 |
| 4,948,134 A | 8/1990 | Suttle et al. | 273/85 |
| 5,116,055 A | 5/1992 | Tracy | 273/138 A |
| 5,249,800 A | 10/1993 | Hilgendorf et al. | 273/138 A |
| 5,275,400 A | 1/1994 | Weingardt et al. | 463/12 |
| 5,280,909 A | 1/1994 | Tracy | 273/138 A |
| 5,344,144 A | 9/1994 | Canon | 273/138 A |
| 5,377,973 A | 1/1995 | Jones et al. | 273/85 CP |
| 5,393,057 A | 2/1995 | Marnell, II | 273/85 CP |
| 5,524,888 A | 6/1996 | Heidel | 463/22 |
| 5,544,892 A | 8/1996 | Breeding | 273/292 |

(Continued)

FOREIGN PATENT DOCUMENTS

CA 2 334 546 8/2001

(Continued)

OTHER PUBLICATIONS

Article for "Easy Riches" by Sigma Game, Strictly Slots, 1 page (Aug. 2001).

(Continued)

*Primary Examiner* — David L Lewis
*Assistant Examiner* — Eric M Thomas
(74) *Attorney, Agent, or Firm* — Nixon Peabody LLP

(57) ABSTRACT

A method of playing a wagering game having a plurality of players playing at a plurality of gaming terminals, the wagering game including a basic game and a bonus game. The method includes the steps of conducting the basic game at a first gaming terminal, fulfilling a bonus game entry event at the first gaming terminal and satisfying, at the first gaming terminal during a bonus game, a bonus prize unlocking event to unlock a bonus prize. The method also includes satisfying, at any of the plurality of gaming terminals, a bonus prize win event subsequent to the bonus prize unlocking event to win a bonus prize and awarding bonus prize to a player satisfying the bonus prize win event.

26 Claims, 10 Drawing Sheets

U.S. PATENT DOCUMENTS

| | | | | |
|---|---|---|---|---|
| 5,564,700 | A | 10/1996 | Celona | 463/27 |
| 5,575,474 | A | 11/1996 | Rossides | |
| 5,577,959 | A | 11/1996 | Takemoto | 463/25 |
| 5,580,063 | A | 12/1996 | Edwards | 273/378 |
| 5,580,309 | A | 12/1996 | Piechowiak et al. | 463/16 |
| 5,609,525 | A | 3/1997 | Ohno et al. | |
| 5,611,730 | A | 3/1997 | Weiss | 463/20 |
| 5,645,486 | A | 7/1997 | Nagao et al. | 463/27 |
| 5,655,961 | A | 8/1997 | Acres et al. | 463/27 |
| 5,766,076 | A | 6/1998 | Pease et al. | 463/27 |
| RE35,864 | E | 7/1998 | Weingardt | 463/28 |
| 5,779,549 | A | 7/1998 | Walker et al. | 463/42 |
| 5,816,918 | A | 10/1998 | Kelly et al. | 463/16 |
| 5,820,459 | A | 10/1998 | Acres et al. | 463/25 |
| 5,823,874 | A | 10/1998 | Adams | 463/17 |
| 5,833,537 | A | 11/1998 | Barrie | |
| 5,839,956 | A | 11/1998 | Takemoto | 463/25 |
| 5,848,932 | A | 12/1998 | Adams | 463/20 |
| 5,855,515 | A | 1/1999 | Pease et al. | 463/27 |
| 5,876,284 | A | 3/1999 | Acres et al. | 463/25 |
| 5,885,158 | A | 3/1999 | Torango et al. | 463/27 |
| 5,941,773 | A | 8/1999 | Harlick | 463/26 |
| 5,957,775 | A | 9/1999 | Cherry | |
| 5,961,384 | A * | 10/1999 | Robinson | 463/10 |
| 6,003,013 | A | 12/1999 | Boushy et al. | 705/10 |
| 6,004,211 | A | 12/1999 | Brenner et al. | |
| 6,007,427 | A | 12/1999 | Wiener et al. | 463/17 |
| 6,012,045 | A | 1/2000 | Barzilai et al. | 705/37 |
| 6,012,982 | A | 1/2000 | Piechowiak et al. | 463/16 |
| 6,012,983 | A | 1/2000 | Walker et al. | |
| 6,015,344 | A | 1/2000 | Kelly et al. | 463/16 |
| 6,047,963 | A | 4/2000 | Pierce et al. | 273/121 B |
| 6,068,553 | A | 5/2000 | Parker | 463/27 |
| 6,077,163 | A | 6/2000 | Walker et al. | |
| 6,089,977 | A | 7/2000 | Bennett | 463/20 |
| 6,089,980 | A | 7/2000 | Gauselmann | 463/27 |
| 6,102,474 | A | 8/2000 | Daley | 296/836 |
| 6,102,799 | A | 8/2000 | Stupak | 463/27 |
| 6,110,043 | A | 8/2000 | Olsen | 463/27 |
| 6,113,098 | A | 9/2000 | Adams | |
| 6,139,013 | A | 10/2000 | Pierce et al. | 273/121 B |
| 6,142,872 | A | 11/2000 | Walker et al. | 463/16 |
| 6,146,273 | A | 11/2000 | Olsen | 463/27 |
| 6,155,925 | A | 12/2000 | Giobbi et al. | 463/20 |
| 6,158,741 | A | 12/2000 | Koelling | 273/292 |
| 6,159,097 | A | 12/2000 | Gura | |
| 6,165,071 | A | 12/2000 | Weiss | |
| 6,168,523 | B1 | 1/2001 | Piechowiak et al. | 463/26 |
| 6,203,010 | B1 | 3/2001 | Jorasch et al. | 273/138.1 |
| 6,206,374 | B1 | 3/2001 | Jones | 273/292 |
| 6,206,782 | B1 | 3/2001 | Walker et al. | 463/25 |
| 6,210,275 | B1 | 4/2001 | Olsen | 463/16 |
| 6,210,277 | B1 | 4/2001 | Stefan | 463/27 |
| 6,217,448 | B1 | 4/2001 | Olsen | 463/25 |
| 6,220,593 | B1 | 4/2001 | Pierce et al. | 273/138.1 |
| 6,224,482 | B1 | 5/2001 | Bennett | 463/20 |
| 6,224,484 | B1 | 5/2001 | Okuda et al. | 463/27 |
| 6,231,445 | B1 | 5/2001 | Acres | 463/42 |
| 6,234,896 | B1 | 5/2001 | Walker et al. | |
| 6,254,481 | B1 | 7/2001 | Jaffe | |
| 6,254,483 | B1 | 7/2001 | Acres | 463/26 |
| 6,273,820 | B1 | 8/2001 | Haste, III | |
| 6,302,790 | B1 | 10/2001 | Brossard | 463/20 |
| 6,311,976 | B1 | 11/2001 | Yoseloff et al. | 273/138 |
| 6,312,332 | B1 | 11/2001 | Walker et al. | 463/23 |
| 6,315,660 | B1 | 11/2001 | DeMar et al. | 463/16 |
| 6,319,125 | B1 | 11/2001 | Acres | 463/25 |
| 6,319,127 | B1 | 11/2001 | Walker et al. | |
| 6,336,859 | B2 | 1/2002 | Jones et al. | 463/13 |
| 6,336,862 | B1 | 1/2002 | Byrne | 463/27 |
| 6,345,824 | B1 | 2/2002 | Selitzky | 273/292 |
| 6,358,149 | B1 | 3/2002 | Schneider et al. | 463/27 |
| 6,361,441 | B1 | 3/2002 | Walker et al. | 463/42 |
| 6,364,765 | B1 | 4/2002 | Walker et al. | |
| 6,364,766 | B1 | 4/2002 | Anderson et al. | 463/16 |
| 6,364,768 | B1 | 4/2002 | Acres et al. | 463/25 |
| 6,365,765 | B1 | 4/2002 | Baldwin et al. | |
| 6,375,567 | B1 | 4/2002 | Acres | 463/25 |
| 6,375,568 | B1 | 4/2002 | Roffman et al. | 463/26 |
| 6,416,409 | B1 | 7/2002 | Jordan | 463/27 |
| 6,431,983 | B2 | 8/2002 | Acres | |
| 6,435,968 | B1 | 8/2002 | Torango | 463/27 |
| 6,439,995 | B1 | 8/2002 | Hughs-Baird et al. | 463/20 |
| 6,482,089 | B2 | 11/2002 | DeMar et al. | 463/20 |
| 6,506,117 | B2 | 1/2003 | DeMar et al. | 463/20 |
| 6,506,118 | B1 | 1/2003 | Baerlocher et al. | 463/25 |
| 6,508,707 | B2 | 1/2003 | DeMar et al. | 463/16 |
| 6,517,433 | B2 | 2/2003 | Loose et al. | 463/20 |
| 6,520,855 | B2 | 2/2003 | DeMar et al. | 463/20 |
| 6,569,018 | B2 | 5/2003 | Jaffe | |
| 6,577,733 | B1 | 6/2003 | Charrin | 380/251 |
| 6,589,115 | B2 | 7/2003 | Walker et al. | 463/25 |
| 6,592,460 | B2 | 7/2003 | Torango | 463/27 |
| 6,599,186 | B1 | 7/2003 | Walker et al. | 463/17 |
| 6,599,188 | B2 | 7/2003 | Hirsch et al. | 463/19 |
| 6,599,193 | B2 | 7/2003 | Baerlocher et al. | 463/27 |
| 6,601,771 | B2 | 8/2003 | Charrin | 235/492 |
| 6,648,762 | B2 | 11/2003 | Walker et al. | 463/25 |
| 6,663,489 | B2 | 12/2003 | Baerlocher | 463/20 |
| 6,712,695 | B2 | 3/2004 | Mothwurf et al. | 463/25 |
| 6,722,981 | B2 | 4/2004 | Kaminkow | 463/20 |
| 6,722,985 | B2 | 4/2004 | Criss-Puszkiewicz et al. | 463/29 |
| 6,733,390 | B2 | 5/2004 | Walker et al. | 463/23 |
| 6,745,236 | B1 | 6/2004 | Hawkins et al. | 709/203 |
| 6,758,757 | B2 | 7/2004 | Luciano, Jr. et al. | |
| 6,776,713 | B2 | 8/2004 | Gauselmann | |
| 6,780,111 | B2 | 8/2004 | Cannon et al. | 463/25 |
| 6,800,027 | B2 | 10/2004 | Giobbi et al. | |
| 6,811,486 | B1 | 11/2004 | Luciano, Jr. | |
| 6,923,721 | B2 | 8/2005 | Luciano et al. | |
| 7,036,012 | B2 | 4/2006 | Charrin | 713/169 |
| 7,182,690 | B2 | 2/2007 | Giobbi et al. | 463/24 |
| 2001/0024971 | A1 | 9/2001 | Brossard | 463/30 |
| 2001/0046893 | A1 | 11/2001 | Giobbi et al. | |
| 2002/0028708 | A1 | 3/2002 | Busch et al. | 463/42 |
| 2002/0039919 | A1 | 4/2002 | Joshi et al. | 463/20 |
| 2002/0077173 | A1 | 6/2002 | Luciano et al. | 463/25 |
| 2002/0077174 | A1 | 6/2002 | Luciano et al. | |
| 2002/0093136 | A1 | 7/2002 | Moody | |
| 2002/0094871 | A1 | 7/2002 | Luciano, Jr. et al. | 463/43 |
| 2002/0107065 | A1 | 8/2002 | Rowe | |
| 2002/0132659 | A1 * | 9/2002 | DeMar et al. | 463/16 |
| 2002/0137560 | A1 * | 9/2002 | DeMar et al. | 463/16 |
| 2002/0137561 | A1 * | 9/2002 | DeMar et al. | 463/16 |
| 2002/0138594 | A1 | 9/2002 | Rowe | 709/219 |
| 2002/0142823 | A1 * | 10/2002 | DeMar et al. | 463/16 |
| 2002/0151345 | A1 | 10/2002 | Byrne | 463/18 |
| 2002/0151349 | A1 | 10/2002 | Joshi | 463/20 |
| 2002/0155874 | A1 | 10/2002 | Byrne | 463/16 |
| 2002/0196342 | A1 | 12/2002 | Walker et al. | 348/157 |
| 2003/0013514 | A1 * | 1/2003 | Cregan et al. | 463/20 |
| 2003/0013515 | A1 | 1/2003 | Rowe et al. | |
| 2003/0013531 | A1 | 1/2003 | Rowe et al. | |
| 2003/0014370 | A1 | 1/2003 | Charrin | 705/65 |
| 2003/0027618 | A1 | 2/2003 | Byrne | 463/16 |
| 2003/0036422 | A1 | 2/2003 | Baerlocher et al. | 463/20 |
| 2003/0036427 | A1 | 2/2003 | Brandstetter et al. | |
| 2003/0036430 | A1 | 2/2003 | Cannon | 463/42 |
| 2003/0045337 | A1 | 3/2003 | Byrne | 463/16 |
| 2003/0050106 | A1 | 3/2003 | Lyfoung | 463/13 |
| 2003/0060266 | A1 | 3/2003 | Baerlocher | 463/20 |
| 2003/0064776 | A1 | 4/2003 | Byrne | 463/16 |
| 2003/0064794 | A1 | 4/2003 | Mead et al. | 463/25 |
| 2003/0078101 | A1 | 4/2003 | Schneider et al. | |
| 2003/0100362 | A1 | 5/2003 | Horniak et al. | |
| 2003/0106769 | A1 | 6/2003 | Weiss | 463/25 |
| 2003/0109306 | A1 | 6/2003 | Karmarkar | 463/40 |
| 2003/0114219 | A1 | 6/2003 | McClintic | 463/25 |
| 2003/0119576 | A1 * | 6/2003 | McClintic et al. | 463/20 |
| 2003/0119579 | A1 | 6/2003 | Walker et al. | 463/21 |
| 2003/0148808 | A1 | 8/2003 | Price | 463/27 |
| 2003/0157979 | A1 | 8/2003 | Cannon et al. | |
| 2003/0181231 | A1 | 9/2003 | Vancura et al. | 463/9 |
| 2003/0186733 | A1 | 10/2003 | Wolf et al. | 463/16 |
| 2003/0195024 | A1 | 10/2003 | Slattery | 463/9 |
| 2003/0211881 | A1 | 11/2003 | Walker et al. | 463/20 |
| 2003/0216166 | A1 | 11/2003 | Baerlocher et al. | 463/20 |

| | | | | |
|---|---|---|---|---|
| 2003/0222402 | A1 | 12/2003 | Olive | 273/292 |
| 2003/0228899 | A1 | 12/2003 | Evans | 463/25 |
| 2003/0236116 | A1 | 12/2003 | Marks et al. | 463/16 |
| 2004/0009808 | A1 | 1/2004 | Gauselmann | 463/25 |
| 2004/0009811 | A1 | 1/2004 | Torango | 463/25 |
| 2004/0038741 | A1 | 2/2004 | Gauselmann | 463/42 |
| 2004/0048644 | A1 | 3/2004 | Gerrard et al. | 463/16 |
| 2004/0053680 | A1 | 3/2004 | Schultz | 463/20 |
| 2004/0142742 | A1 | 7/2004 | Schneider et al. | |
| 2004/0209662 | A1 | 10/2004 | Wadleigh | 463/16 |
| 2005/0003886 | A1 | 1/2005 | Englman et al. | 463/25 |
| 2005/0159207 | A1 | 7/2005 | Thomas | 463/20 |
| 2006/0068893 | A1 | 3/2006 | Jaffe et al. | 463/20 |
| 2006/0079316 | A1 | 4/2006 | Flemming et al. | 463/25 |
| 2006/0079317 | A1 | 4/2006 | Flemming et al. | 463/25 |
| 2006/0084495 | A1 | 4/2006 | Jaffe et al. | 463/20 |
| 2006/0084496 | A1 | 4/2006 | Jaffe et al. | 463/20 |
| 2006/0089194 | A1 | 4/2006 | Joshi et al. | 463/25 |
| 2007/0167218 | A1 | 7/2007 | Rothschild | 463/25 |
| 2007/0254734 | A1 | 11/2007 | Gilmore et al. | 463/20 |
| 2007/0259706 | A1 | 11/2007 | Anderson et al. | 463/16 |
| 2007/0259713 | A1 | 11/2007 | Fiden et al. | 463/25 |
| 2007/0265060 | A1 | 11/2007 | Hornik et al. | 463/20 |
| 2007/0298856 | A1 | 12/2007 | Gilmore et al. | 463/16 |
| 2008/0113770 | A1 | 5/2008 | Gelber et al. | 463/25 |

FOREIGN PATENT DOCUMENTS

| | | | |
|---|---|---|---|
| DE | 195 15 983 | A1 | 11/1996 |
| DE | 196 24 321 | A1 | 1/1998 |
| EP | 0 521 599 | A1 | 1/1993 |
| GB | 2 153 572 | A | 8/1985 |
| GB | 2 181 589 | A | 4/1987 |
| GB | 2 242 300 | A | 9/1991 |
| GB | 2 313 792 | A | 10/1997 |
| GB | 2 333 880 | A | 8/1999 |
| WO | WO 99 03078 | A1 | 1/1999 |
| WO | WO 99/19037 | A1 | 4/1999 |
| WO | WO 99/29381 | | 6/1999 |
| WO | WO 9929381 | | 6/1999 |
| WO | WO 01/33478 | A1 | 5/2001 |
| WO | WO 03/026754 | A1 | 4/2003 |
| WO | WO 03/083789 | A1 | 10/2003 |
| WO | WO 2005082480 | A1 | 9/2005 |
| WO | WO 2006002241 | A2 | 1/2006 |
| WO | WO 2006004831 | A2 | 1/2006 |
| WO | WO 2006004832 | A2 | 1/2006 |
| WO | WO 2006005073 | A2 | 1/2006 |
| WO | WO 2006017036 | A1 | 2/2006 |
| WO | WO 2006017067 | A1 | 2/2006 |
| WO | WO 2006017068 | A1 | 2/2006 |
| WO | WO 2006020811 | A2 | 2/2006 |
| WO | WO 2006026250 | A2 | 3/2006 |
| WO | WO 2006044252 | A2 | 4/2006 |

OTHER PUBLICATIONS

Article for "Millioniser" by Glenn Haussman, Strictly Slots, pp. 50-53 (Mar. 2004).

Product Sheet for "Big Games Safari," IGT, 24 pages (2000).

"New '97 Games," International Gaming & Wagering Business, 24 pages (Mar. 1997).

* cited by examiner

WAGERING GAME WITH AWARD UNLOCKING FEATURE

CROSS-REFERENCE TO RELATED APPLICATION

This application claims the benefit of the U.S. Provisional Application 60/615,461 filed on Oct. 1, 2004 and entitled "Wagering Games With Award Unlocking Feature" and this provisional application is hereby incorporated by reference in its entirety.

TECHNICAL FIELD

The present disclosure relates generally to wagering games and, more particularly, to a wagering game with an award unlocking feature and to a gaming terminal and gaming system directed thereto, as well as to ancillary games incorporating such features.

BACKGROUND

Gaming machines, such as slot machines, video poker machines, and the like, have been a cornerstone of the gaming industry for several years. Generally, the popularity of such machines with players is dependent on the likelihood (or perceived likelihood) of winning money at the machine and the intrinsic entertainment value of the machine relative to other available gaming options. Where the available gaming options include a number of competing machines and the expectation of winning each machine is roughly the same (or believed to be the same), players are most likely to be attracted to the most entertaining and exciting of the machines.

Consequently, shrewd operators strive to employ the most entertaining and exciting machines available because such machines attract frequent play and, hence, increase profitability to the operator. In the competitive gaming machine industry, there is a continuing need for gaming machine manufacturers to produce new types of games, or enhancements to existing games, which will attract frequent play by enhancing the entertainment value and excitement associated with the game.

One concept that has been successfully employed to enhance the entertainment value of a game is that of a "bonus" game which may be played in conjunction with a "basic" game. The bonus game may comprise any type of game, either similar to or completely different from the basic game, and is entered upon the occurrence of a selected event or outcome of the basic game. Such a bonus game produces a significantly higher level of player excitement than the basic game because it provides a greater expectation of winning than the basic game.

Another concept that has been employed is the use of a bonus prize. In the gaming industry, a "progressive" involves collecting coin-in data from participating gaming device(s) (e.g., slot machines), contributing a percentage of that coin-in data to a jackpot amount, and awarding that jackpot amount to a player upon the occurrence of a certain jackpot-won event. The percentage of the coin-in is determined prior to any result being achieved and is independent of any result. A jackpot-won event typically occurs when a "bonus winning position" is achieved at a participating gaming device. If the gaming device is a slot machine, a bonus winning position may, for example, correspond to alignment of bonus prize reel symbols along a certain pay-line. The initial bonus prize is a predetermined minimum amount. That jackpot amount, however, progressively increases as players continue to play the gaming machine without winning the jackpot. Further, when several gaming machines are linked together such that several players at several gaming machines compete for the same jackpot, the jackpot progressively increases at a much faster rate, which leads to further player excitement.

In some bonus games, there are multiple levels of bonus prizes or awards, which are designed to increase player excitement. However, in some of these games, the player can only win one of the levels of bonus prizes. This can lower the level of player excitement if the player wins the smallest award, because the player is not going to win the larger level bonus prize or award.

A need exists for increasing player excitement by altering and/or improving wagering game formats.

SUMMARY

Various aspects of the present concept are presented below.

A method of playing a wagering game having a plurality of players playing at a plurality of gaming terminals, the wagering game including a basic game and a bonus game. The method includes the steps of conducting the basic game at a first gaming terminal, fulfilling a bonus game entry event at the first gaming terminal and satisfying, at the first gaming terminal during a bonus game, a bonus prize unlocking event to unlock a bonus prize. The method also includes satisfying, at any of the plurality of gaming terminals, a bonus prize win event subsequent to the bonus prize unlocking event to win a bonus prize and awarding bonus prize to a player satisfying the bonus prize win event.

In accordance with another embodiment a method of playing a bonus game includes conducting a wagering game at a first gaming terminal, fulfilling a bonus game entry event at the first gaming terminal, and advancing a game element along a game board comprising a plurality of stations, wherein a plurality of the game board stations each comprises a distinct bonus game.

In yet another embodiment, a gaming terminal controlled by a game control system is configured to play a wagering game in combination with the game control system and player inputs. The gaming terminal includes an input device for receiving inputs from a player during the wagering game, the inputs including a wager amount, and a display for displaying a randomly selected outcome of the wagering game in response to receiving the wager amount from the player. In response to satisfaction of a bonus game entry condition by a randomly selected outcome of the wagering game, the game control system permits entry of the player into a bonus game comprising a plurality of distinct bonus games, each of the plurality of distinct bonus games being associated with one space on a game board upon which a player's game element is moved. The game control system generates a random number within a predetermined range of numbers and advances the game element a number of spaces on the game board corresponding to the random number to occupy a space on the game board corresponding to one of a plurality of the distinct bonus games. In one optional aspect, the occupying of a space on the game board may satisfy a bonus prize win event only when a predetermined minimum wager has been placed during the wagering game leading to the bonus game. In another aspect, prior to the generation of the random number by the game control system and associated advancement of the game element along the spaces of the game board, the game control system may optionally permit the player to input an additional wager amount to positively influence at least one aspect of the ancillary game play with respect to that player. In yet another optional aspect, the game control system, upon an additional wager amount input by the player, may be configured to associate a number of the spaces on the game board with a free turn, an award amount, and/or an automatic unlocking of a bonus prize amount for a present bonus prize level.

In still another embodiment, a gaming system includes a plurality of gaming terminals having at least one display, at least one data input device, at least one wager input device, and at least one communication device, each terminal being configured to run, in accord with an instruction set, a wagering game comprising a bonus game. The gaming system also includes a communications network linking the plurality of gaming terminals through the communication device of each gaming terminal. The wagering game includes a device by which a player at a gaming terminal may enter a bonus game including a bonus prize unlocking event which, when satisfied by any of the players at any of the plurality of gaming terminals, unlocks the bonus prize for winning by any player upon satisfaction of a bonus prize win event.

In one aspect of the present concepts, a gaming system is provided including a plurality of gaming terminals having at least one display, at least one data input device, at least one wager input device, and at least one communication device, each terminal being configured to conduct a wagering game comprising a bonus game. A communications network links the plurality of gaming terminals through the communication device of each gaming terminal. In this aspect, the wagering game comprises a device by which a player at a gaming terminal may enter a bonus game and the bonus game includes a bonus prize unlocking event. The bonus prize unlocking event, when satisfied by any of the players at any of the plurality of gaming terminals, unlocks the bonus prize for winning by any player upon satisfaction of a bonus prize win event. In various other versions of this aspect, the bonus game may include a bonus prize unlocking event which, when satisfied by any of the players at any of the plurality of gaming terminals, unlocks the bonus prize for winning to a subset group selected from the group of all players, whereupon any member of the subset group may win the bonus prize upon satisfaction of a bonus prize win event. The bonus game may, for example, include a multi-level bonus game or a plurality of distinct substantially simultaneously occurring bonus games. In various other versions, the wagering game system may award a predetermined award other than the bonus prize for a player satisfying a bonus prize unlocking event.

In another aspect of the present concepts, a method of playing a multi-player wagering game having a plurality of players includes the acts of conducting a basic game at a plurality of gaming terminals and conducting an ancillary game at a subset of the plurality of gaming terminals following satisfaction of an ancillary game entry event at each of the subset of gaming terminals. The method further includes allocating, in the ancillary game, a portion of each player's wagers to an ancillary game jackpot amount and unlocking an ancillary game jackpot to all participants of the ancillary game upon satisfaction of an ancillary game unlocking event by one of the participants of the ancillary game. This method may further include, for example, the act of awarding an ancillary game jackpot to a player of the ancillary game satisfying an ancillary game jackpot win event, wherein the ancillary game jackpot win event is a different event than the ancillary game unlocking event.

In still another aspect of the present concepts, there is provided a gaming system including at least one display, at least one gaming terminal for playing a wagering game and a bonus game, and a controller coupled to the at least one gaming terminal and the at least one display, the controller triggering the bonus game when a start-bonus game outcome is achieved in the wagering game. In this aspect, the controller is operative to (i) cause the display to display a representation of a bonus game in response to the start-bonus outcome being achieved, (ii) accept a player instruction to initiate play of the bonus game for the player; (iii) determine an outcome of the bonus game for the player; (iv) determine whether the outcome of the bonus game for the player corresponds to a predetermined bonus prize unlocking event; and (v) unlock the bonus prize for awarding upon the occurrence of a subsequent bonus prize win event.

In yet another aspect of the present concepts, there is provided a method of playing a bonus game, including the acts of conducting a wagering game at a first gaming terminal, fulfilling a bonus game entry event at the first gaming terminal, and joining, from a plurality of available bonus games, a selected bonus game.

Still another aspect of the present concepts includes a gaming system including a plurality of gaming terminals having a display, a data input device, a wager input device, and a communication device, each terminal being configured to run, in accord with an instruction set, a wagering game comprising a bonus game. The gaming system also includes a communications network linking the plurality of gaming terminals through the communication device of each gaming terminal. The wagering game itself includes a device by which a player at a gaming terminal may enter a bonus game. In this aspect, a player at a gaming terminal granted entry to a bonus game is permitted to selectively join one of a plurality of available bonus games.

Another aspect of the present concepts includes a method of playing a wagering game, the wagering game having a basic game and an ancillary game including at least one jackpot, the method including a plurality of players playing at a plurality of gaming terminals, the method comprising the steps of conducting the basic game at a first gaming terminal, fulfilling an ancillary game entry event at the first gaming terminal and satisfying, at the first gaming terminal during an ancillary game, an ancillary game jackpot unlocking event to unlock an ancillary game jackpot. The method further includes satisfying, at any of the plurality of gaming terminals, a jackpot win event subsequent to the ancillary game jackpot unlocking event to win an ancillary game jackpot. The method also includes awarding an ancillary game jackpot to a player satisfying the ancillary game jackpot win event.

In another aspect of the present concepts, a gaming system includes a plurality of gaming terminals having at least one display, at least one data input device, at least one wager input device, and at least one communication device, each terminal being configured to run a wagering game and an ancillary game. A communications network links the plurality of gaming terminals through the communication device of each gaming terminal. The wagering game includes a device by which a player at a gaming terminal may enter an ancillary game. The ancillary game includes a jackpot unlocking event which, when satisfied by any of the players at any of the plurality of gaming terminals, unlocks the ancillary game jackpot for winning by any player upon satisfaction of an ancillary game jackpot win event.

In yet another aspect of the present concepts, a gaming system includes at least one display, at least one gaming terminal for playing a wagering game and an ancillary game, and a controller coupled to the at least one gaming terminal and the at least one display, the controller triggering the ancillary game when a start-ancillary game outcome is achieved in the wagering game. The controller is operative to (i) cause the display to display a representation of an ancillary game in progress in response to the start-ancillary game outcome being achieved, (ii) accept a player instruction to initiate play of the ancillary game for the player; (iii) determine an outcome of the ancillary game for the player; (iv) determine whether the outcome of the ancillary game for the player corresponds to a predetermined ancillary game jackpot unlocking event; and (v) unlock the ancillary game jackpot for awarding upon the occurrence of a subsequent ancillary game jackpot win event.

In another method of playing a wagering game including a basic game and an ancillary game in accord with at least some aspects of the present concepts, the method includes, for a plurality of players playing at a plurality of gaming terminals, the acts of conducting the basic game at a first gaming terminal, fulfilling an ancillary game entry event at the first gaming terminal, and satisfying, at the first gaming terminal during an ancillary game, an award unlocking event to unlock an award. The method further includes satisfying, at any of the plurality of gaming terminals, an award win event subsequent to the award unlocking event, and awarding the award to a player satisfying the award win event. This method may optionally include the additional steps of providing an award having a plurality of discrete states, each state being associated with a different value, and determining a state of the award. The unlocking event may, for example, be based on a state of the award. The method may also include the act or acts of incrementing the award to a higher one of the plurality of discrete states following the awarding step and/or incrementing the award to a lowest one of the plurality of discrete states following the awarding step if the state of the award was the highest one of the plurality of discrete states.

Another method of playing a wagering game in accord with at least some aspects of the present concepts includes conducting a wagering game at a first gaming terminal, fulfilling an ancillary game entry event at the first gaming terminal, and advancing a game element along a game board comprising a plurality of stations. In a first aspect of this method, at least one of the plurality of the stations comprises a locked award. In a second aspect of this method, each of the plurality of the stations comprises a locked award. In a third aspect of this method, at least one of the plurality of the stations comprises a sequentially locked award. In accord with this third aspect, the advancing step may further comprise the act of moving the game element a number of game positions corresponding to a random number within a predetermined range, the random number being generated by a game control system, to occupy a game position corresponding to the at least one of the plurality of stations. Further acts in accord with at least the noted third aspect may include satisfying an award unlocking event through association of occupation of the at least one of the plurality of stations by the game piece, holding the sequentially locked award unlocked for a predetermined period of time following the satisfying step, and/or providing a sequentially locked award having a plurality of discrete states, each state having a different value. The above-noted third aspect of the method may further include acts of holding the sequentially locked award unlocked following the satisfying step until a game element associated with one of the plurality of gaming terminals occupies the at least one of the plurality of stations, awarding an award to the one of the plurality of gaming terminals associated with the game element which occupies the at least one of the plurality of stations, and/or incrementing the sequentially locked award to another one of the plurality of discrete states and locking the sequentially locked award.

A gaming terminal controlled by a game control system and being configured to play a wagering game or a networked-wagering game is also provided in accord with at least some aspects of the present concepts and includes an input device for receiving inputs from a player during the wagering game or networked-wagering game, the inputs including a wager amount, and a display for displaying a randomly selected outcome of the wagering game or networked-wagering game in response to receiving the wager amount from the player. In response to satisfaction of an ancillary game entry condition by a randomly selected outcome of the wagering game or networked-wagering game, the game control system permits entry of the player into an ancillary game having a board-game theme, wherein the game control system generates a random number within a predetermined range of numbers and advances a game element a number of stations on the game board corresponding to the random number to occupy a station on the game board. At least one of the plurality of the stations comprises a locked award. In another aspect of the wagering game or networked-wagering game, at least one of the plurality of stations may comprise a sequentially locked award. In one optional configuration, movement of the game element to occupy a game position corresponding to the at least one of the plurality of stations comprises an award unlocking event. The optional sequentially locked award may comprise a plurality of discrete states, each state having a different value, and may remain unlocked for a predetermined period of time following an award unlocking event. The sequentially locked award may also remain unlocked until a game element occupies the at least one of the plurality of stations, at which time an award win event is fulfilled and an award is awarded. The sequentially locked award may then optionally be incremented to another one of the plurality of discrete states and again locked. The networked-wagering game may include a group-game.

In accord with one aspect of the present concepts, a method of playing an ancillary game is provided which includes conducting a wagering game at a first gaming terminal, fulfilling an ancillary game entry event at the first gaming terminal, and joining, from a plurality of available ancillary games, a selected ancillary game.

Still another aspect of the present concepts includes a gaming system including a plurality of gaming terminals having a display, a data input device, a wager input device, and a communication device, each terminal being configured to run, in accord with an instruction set, a wagering game comprising an ancillary game. Also included is a communications network linking the plurality of gaming terminals through the communication device of each gaming terminal. The wagering game includes a device by which a player at a gaming terminal may enter an ancillary game and a player at a gaming terminal granted entry to an ancillary game is permitted to selectively join one of a plurality of available ancillary games.

Another aspect of the present concepts includes a method of playing a wagering game, the wagering game having a basic game and a progressive game including a plurality of successive progressive jackpots, the method including a plurality of players playing at a plurality of gaming terminals. This method includes the acts of conducting the basic game at a first gaming terminal, fulfilling a progressive game entry event at the first gaming terminal, and satisfying, at the first gaming terminal during a progressive game, a progressive jackpot unlocking event to unlock a progressive jackpot. The method also includes the acts of satisfying, at any of the plurality of gaming terminals, a progressive jackpot win event subsequent to the progressive jackpot unlocking event, and awarding progressive jackpot to a player satisfying the progressive jackpot win event.

Yet another aspect of the present concepts includes a gaming terminal controlled by a game control system and being configured to play a progressive game, including an input device for receiving inputs from a player during the progressive game and a display for displaying an outcome of a player's progressive game play. In this aspect of the present concepts, the progressive game includes a plurality of progressive jackpot levels that must be sequentially won through the sequential occurrence of progressive jackpot-win events. This gaming terminal may optionally include a networked-game platform upon which the gaming terminal may be connected to at least one other gaming terminal or controller and upon which networked-game platform the progressive game may be serviced. In this latter optional configuration, each progressive jackpot level is locked and must be unlocked by a progressive jackpot unlocking event prior to enabling awarding of the progressive level jackpot upon the occurrence of a progressive jackpot win event.

In another aspect, a gaming system in accord with the present concepts includes a plurality of gaming terminals having at least one display, at least one data input device, at least one wager input device, and at least one communication device, each terminal being configured to conduct a progressive game. In this aspect, a network and/or a service links the plurality of gaming terminals to the progressive game. The progressive game includes a progressive jackpot unlocking event which, when satisfied by any of the players at any of the plurality of gaming terminals, unlocks the progressive jackpot for winning by any player upon satisfaction of a progressive jackpot win event. Optionally, the progressive game may comprise a multi-level progressive game.

The above summary is not intended to represent each embodiment or aspect of the present disclosure and the detailed description and figures provided herewith are merely exemplary of the concepts disclosed herein.

BRIEF DESCRIPTION OF THE DRAWINGS

The foregoing and other advantages will become apparent upon reading the following detailed description and upon reference to the drawings.

Figure 1:
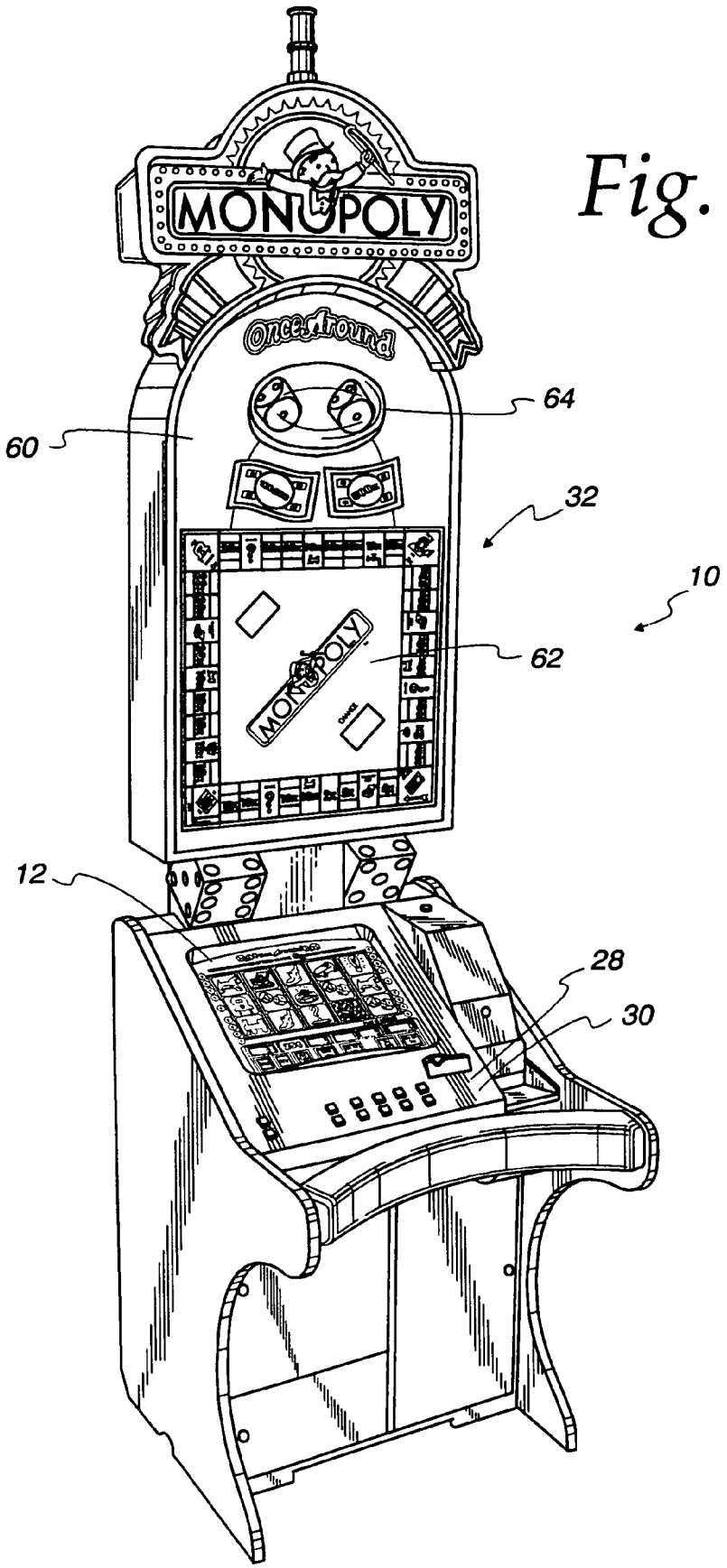
FIG. 1 is a perspective view of a video gaming machine with a board game theme according to one aspect of the disclosure.

While the disclosed concepts are susceptible to various modifications and alternative forms, specific embodiments have been shown by way of example in the drawings and will be described in detail herein. It should be understood, however, that the disclosed concepts are not intended to be limited to the particular forms disclosed. Rather, the disclosed concepts are to cover all modifications, equivalents, and alternatives falling within the spirit and scope of the disclosed concepts as defined by the appended claims.

DETAILED DESCRIPTION OF THE ILLUSTRATED EMBODIMENTS

A wagering game with an award unlocking feature and a gaming terminal and gaming system directed thereto are described herein by way of the following exemplary aspects.

In accord with the present concepts, a wagering game is provided wherein a potential award is locked and can be unlocked by the satisfaction of an award-unlocking event. Following satisfaction of the award-unlocking event, the award may be claimed by a player satisfying an award-win event, which may or may not duplicate or resemble the award-unlocking event. The award may be a sequential award comprising a plurality of sequential award levels which will increment upwardly upon each occurrence of an award win event until such time as the highest level of such sequential award is reached and awarded, whereupon the sequential award would be reset to an initial level. Stated differently, wagering games in accord with the present concepts comprise a persistent state award outcome wherein potential awards are first unlocked and then subsequently satisfied and awarded following determination of the appropriate persistent state. These concepts apply to both an individual game played by a single player at a gaming terminal or to a group of players playing on a plurality of terminals. Thus, a player who unlocked an award may or may not be the player who ultimately wins the award. Moreover, it is to be understood that these concepts apply to any game inclusive of basic wagering games and ancillary games, which include, but are not limited to, bonus games, secondary games, and progressive games. Further, the term award broadly includes any type of award without semantical distinction including, for example, any award, prize, benefit, jackpot, pay-off, payout, advantage, gift, incentive, perk, kitty, pot, winning, credit, inducement, or recompense.

Exemplary examples of these concepts are provided below.

FIG. 1 depicts a gaming machine 10 with a board game theme implementing one aspect of the present concepts. In one embodiment, the gaming machine 10 is operable to play a game entitled MONOPOLY ONCE AROUND™, based on the popular MONOPOLY® board game. MONOPOLY® is a registered trademark owned by and used with permission by Hasbro, Inc. and Hasbro International, Inc., Pawtucket, R.I. Nevertheless, it will be appreciated that the gaming machine 10 may be implemented with any of several other board game themes other than MONOPOLY® and other non-board game themes, such as cards, dice, and conventional slots, as further described herein.

In the aspect of FIG. 1, gaming machine 10 includes a video display 12 and a top box display 32. The video display 12 may comprise a dot matrix, CRT, LED, LCD, electroluminescent display or generally any type of video display known in the art, which may optionally double as a data input device (e.g., a touch-screen). The top box display 32 has a facing surface 60 comprising a partially translucent material such as glass, plastic, Plexiglas or the like which includes an adaptation of a game board 62 (e.g., MONOPOLY®) displayed thereon. The game board 62 is backlit by one or more lights 66 (not visible in FIG. 1) in the top box display 32. A pair of mechanical dice 64 are displayed near the top of the top box display 32.

Figure 2:
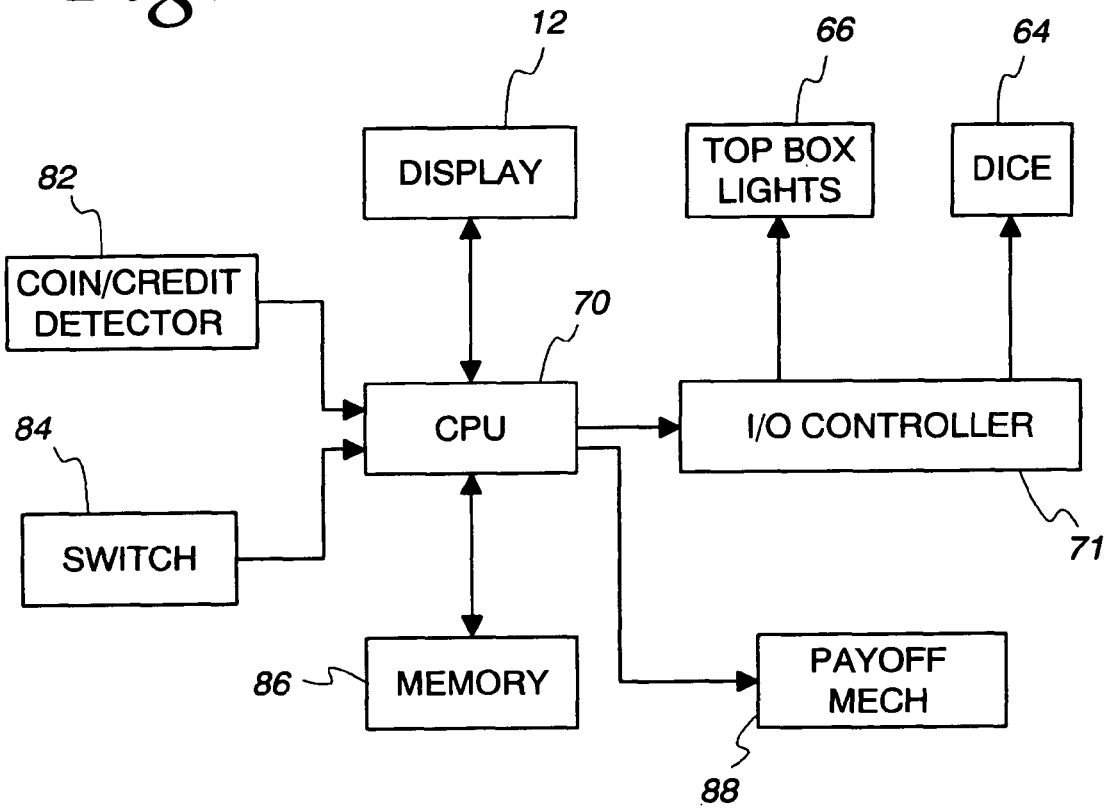
FIG. 2 is a block diagram of the gaming machine of FIG. 1.
Figure 3:
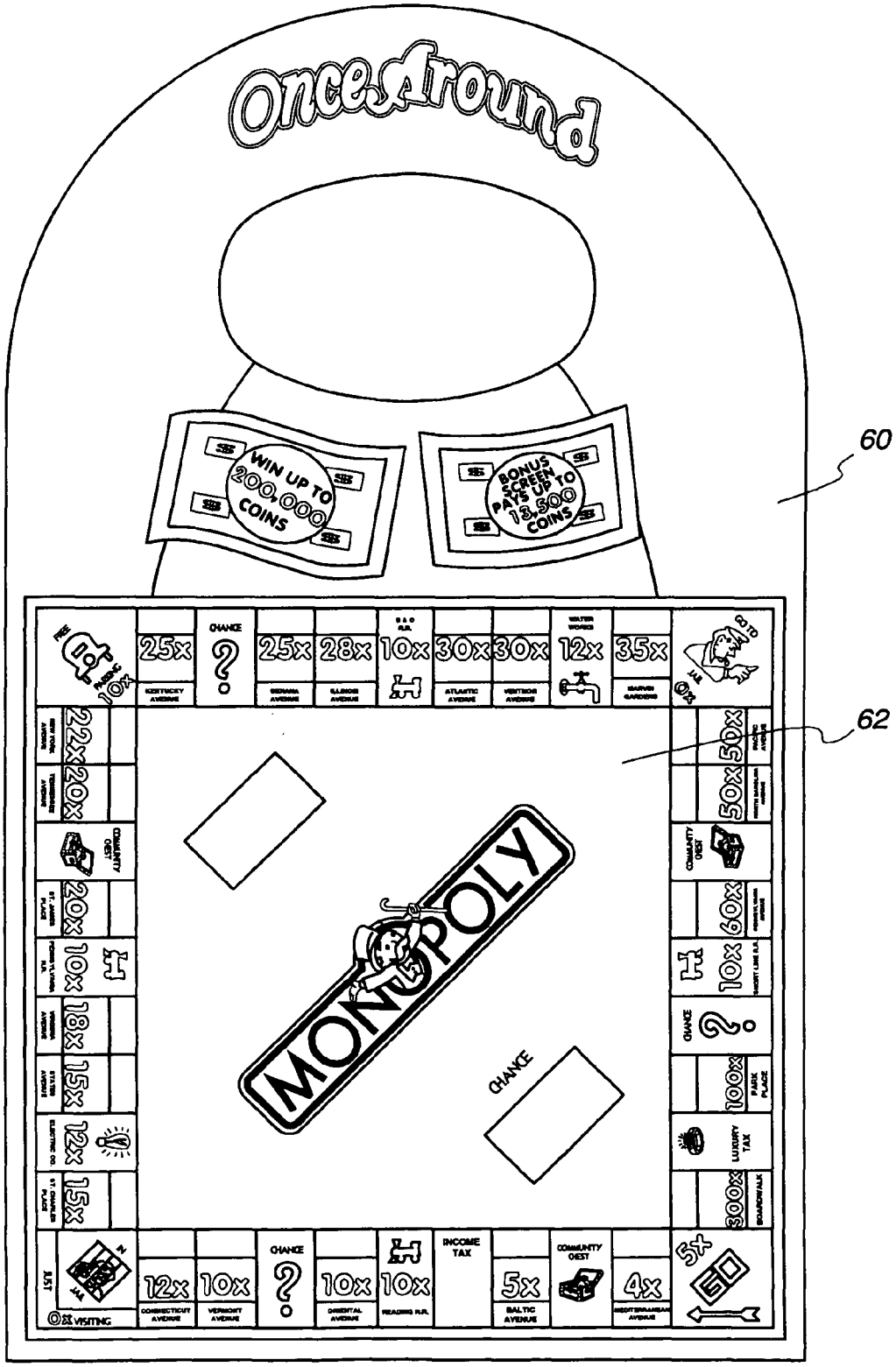
FIG. 3 shows the top box glass of the gaming machine of FIG. 1.

FIG. 2 is a block diagram of a control system suitable for operating the gaming machine 10. Coin/credit detector 82 signals a CPU 70, which may comprise one or more processors and may optionally be remotely disposed (i.e., not within the gaming machine 10), when a player has inserted a number of coins or played a number of credits. A CPU 70 is operatively associated with software, instructions, and/or firmware, which collectively comprise a game system or game control system. This game control system controls substantially every aspect of game play, save for aspects involving choices or selections made by a player. After the player has selected and activated a switch 84 (e.g., by pulling a lever, pushing a button, or touching the screen), the CPU 70 operates to display a plurality of reels, such as reels 14, 16, 18, 20 and 22 on the video screen 12. Then, the player activates one or more selected pay-lines 72-80 and presses the "Spin Reels" button 36 or "Max Bet Spin" button 37 to "spin" the reels, as will be described in greater detail in relation to FIG. 4. The CPU 70 randomly selects a game outcome and causes the video display 12 to display indicia (e.g., symbols on reels 14, 16, 18, 20 and 22) corresponding to the pre-selected game outcome. In one aspect, the reel symbols define the basic game outcome and include: "RICH UNCLE PENNYBAGS" ("PENNY"), "DICE," "CAR," "DOG," "SHOE," "RING," "TRAIN," "PARK," "LIGHT," "CHEST" and "CHANCE," but are not limited thereto.

A system memory 86 stores control software, operational instructions and data associated with the gaming machine 10. System memory may comprise any conventional memory device encoding information electrically, physically/optically, or magnetically, including, but not limited to, a solid state memory or a disk drive for reading a magnetic disk or optical disk. In one embodiment, the memory 86 comprises a separate read-only memory (ROM) and battery-backed random-access memory (RAM). However, it will be appreciated that the memory 86 may be implemented on any of alternative types of memory structures or may be implemented on a single memory structure. A payoff mechanism 88 is operable in response to instructions from the CPU 70 to award a payoff of coins or credits to the player in response to certain winning combinations stored in memory 86. As will be described in detail hereinafter, the payoff amounts corresponding to certain combinations is predetermined according to a pay table stored in system memory 86. A separate I/O controller 71 coupled to the CPU 70 operates the mechanical dice 64 and lights 66.

Gaming terminal 10 is typically operated as part of a gaming network including a progressive game control system that controls the play of the progressive games and includes associated control circuitry and memory devices. Gaming terminal 10 comprises multiple I/O ports (serial, parallel, IR) to communicate data to a host or distributed computer system to enable the performance of specific functions related to the communicated data (e.g., accounting, player-tracking, or a progressive game control system, etc). To set up a typical serial communication hardware link to the host system, a typical RS-232 point-to-point communication protocol that is often present in the gaming terminal 10 is converted to an RS-485 (or RS-485-type) master-slave protocol. To perform this function, a Slot Machine Interface Board (SMIB) is used by the gaming terminal 10. One SMIB is typically present for each communication port in the gaming terminal 10. Such conversion from the RS-232 to the RS-485 protocol advantageously eliminates some of weaknesses of the RS-232 protocol by minimizing wiring requirements. The SMIB may also have an embedded proprietary host communication protocol to permit the SMIB to convert the RS-232 input data from a proprietary gaming terminal protocol to the RS-485 (or proprietary RS-485-type) host communication protocol. The SMIB may poll the gaming terminal 10 for data, as with the SAS protocol, or the SMIB may only listen for data being transmitted from the gaming terminal 10 as it is produced on an event-driven basis. This data is stored, such as on the SMIB, and is accessible to the host or polling computer via the RS-485 side of the SMIB. The RS-485 side of the SMIB takes that data, when polled by the host, which in this case is the progressive game control system 40, and transmits it typically in a proprietary RS-485-type communication protocol to the progressive game control system. It should be noted that the gaming terminal 10 can initially be designed to be configured for a typical RS-485 protocol, instead of the typical RS-232 protocol.

The gaming terminal 10 and associated gaming control system is also capable of executing such wagering games on or through a server or service. A service comprises any type of program or instruction set that provides services to programs, controllers, or users in the same computer or processor or in other computers or processors and may be implemented in a centralized or in a distributed or de-centralized architecture. For example, a service may be implemented in combination with an associated computer or controller to configure a plurality of gaming terminals in a peer-to-peer architecture, a client-server based architecture, or even a master/slave architecture. In one implementation, each gaming terminal 10 is provided with any combination of hardware, software, and/or firmware permitting the gaming terminal to transmit and/or receive signals, preferably both, to permit each gaming terminal to communicate directly with at least one other gaming terminal in a peer-to-peer arrangement. Non-limiting examples of gaming system arrangements are provided in U.S. Pat. No. 6,749,510 and U.S. Patent Application Publication No. 20030232650 titled "Dynamic Configuration of a Gaming System" to Beatty, each of which is incorporated by reference herein in its entirety. As used herein, the terms networked-wagering game or networked-gaming platform are used to generally refer to any direct or indirect connection between two or more gaming terminals 10 or between a single gaming terminal and another computer or controller achieved by any conventional scheme such as, but not limited to, those noted above.

The gaming machine 10 is operable to play a "basic" game and an ancillary game, which could include a bonus game, a secondary game, or a progressive game. For brevity, the following example will focus primarily on the aspect including a bonus game, although other types of ancillary games are equally applicable and fall within the claimed subject matter. The basic game is implemented on the video display 12 on a predetermined number of video simulated spinning reels (e.g., 14, 16, 18, 20 and 22)(hereinafter "reels") with a predetermined number pay-lines (e.g., 72-80), as best observed in FIG. 4. Generally, game play is initiated by inserting a number of coins or playing a number of credits, causing the CPU 70 (FIG. 2) to activate a number of pay-lines corresponding to the number of coins or credits played. After activation of the pay-lines, the reels 14, 16, 18, 20 and 22 are set in motion by either pulling a lever (not shown), pressing a push button, or touching a touch screen "key" on the video display 12.

Figure 4:
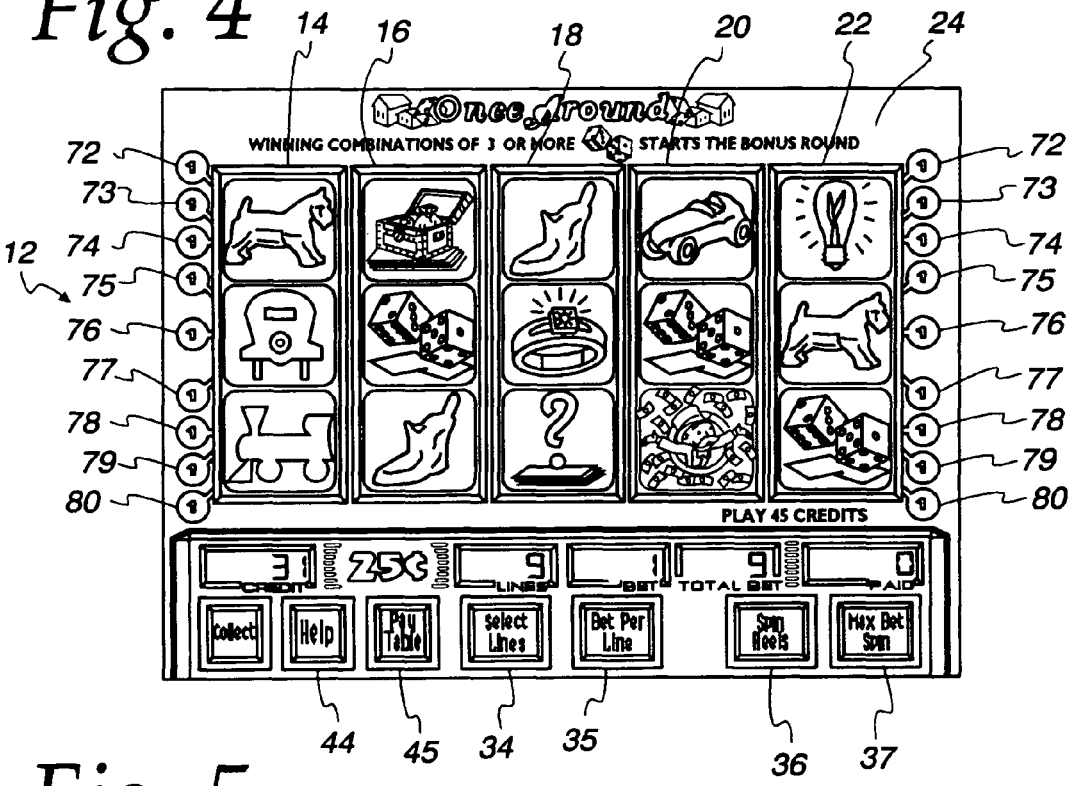
FIG. 4 is an illustration of a five-reel, nine-line video gaming machine basic game which may be implemented on the gaming machine of FIG. 1.

In the embodiment of FIG. 4, each of the pay-lines 72-80 extend through one symbol on each of the five reels 14, 16, 18, 20 and 22. For example, pay-line 72 starts at the upper left symbol (e.g., "DOG") on reel 14, extends through the center symbol (e.g., "DICE") on reel 16, the lower symbol (e.g., "CHANCE") on reel 18, the center symbol (e.g., "DICE") on reel 20 and terminates at the top symbol (e.g., "ELECTRIC CO.," hereinafter "LIGHT") on reel 22.

In one embodiment, the player selects the number of pay-lines, which generally ranges between one and nine, inclusive, but could be more than nine, to play by pressing one of the five buttons in the top row 28 or by using the "Select Lines" key 34 on the video display 12. The player then chooses one of the five buttons in the bottom row 30 that correspond to the number of coins or credits to bet on each of the nine or more pay-lines. Selecting one of the buttons in the bottom row 30 sets the five video reels, 14, 16, 18, 20 and 22 in "motion". As an alternative, the player may touch the "Bet Per Line" key 35 on the video display 12 until the desired bet is displayed and then touch the "Spin Reels" key 36 on the video display 12 to begin the game. As another alternative, if the player wishes to bet the maximum amount of lines and the maximum bet per line, the player may touch the "Max Bet Spin" key 37 on the video display 12 to begin the game. In one embodiment, the game can be set for a maximum bet of 5 or 10 credits on each pay-line for a maximum total bet of 45 or 90 credits per game. The CPU 70 assigns an equal amount of credits bet for each pay-line and then spins all five reels 14, 16, 18, 20 and 22.

The CPU 70 uses a random number generator (not shown) to select a game outcome (e.g., "basic" game outcome) corresponding to a particular set of reel "stop positions". The CPU 70 then causes each of the video reels 14, 16, 18, 20 and 22 to stop at a pre-selected stop position. Video symbols (see FIG. 4) are displayed on the reels 14, 16, 18, 20 and 22 to graphically illustrate the reel stop position and indicate whether the stop position of the reels represents a winning game outcome. Winning "basic" game outcomes (e.g., symbol combinations resulting in payment of coins or credits) are identifiable by a pay table, such as shown in Table A-1 of U.S. Pat. No. 6,315,660, which is hereby incorporated by reference in its entirety.

In one embodiment, the pay table is affixed to the machine 10 and/or displayed by the video display 12 in response to a command by the player (e.g., by pressing the "PAY TABLE" button 45). The pay table enables the player to view the winning combinations and their associated payoff amounts. If the displayed symbols stop in a winning combination, the game awards the player the award corresponding to the award in the pay table for that combination multiplied by the amount of credits bet on the winning pay-line. The winning combination may comprise one or more symbols arranged along a pay line or displayed anywhere on reels 14, 16, 18, 20 and 22 (i.e., scattered symbols not on same pay line).

As noted in U.S. Pat. No. 6,315,660, incorporated herein by reference in its entirety, a winning combination (e.g., a "start-ancillary game" outcome) may entitle a player to enter an ancillary game. In accord with the present concepts, an ancillary game may occur as a separate outcome completely unrelated to the concepts discussed herein. In other words, games in accord with the present concepts may be entered through an ancillary game, rather than directly through a basic wagering game. Alternatively, the concepts herein may be integrated into a basic wagering game without requiring entry into an ancillary game.

As previously noted, an ancillary game may be triggered by an event in a basic wagering game. The ancillary game may include, for example, a bonus game, a secondary game, and/or progressive game. Further, where specific examples of ancillary games are recited in the examples which follow, it is to be understood that the present concepts are not limited merely to the illustrated example and the present concepts include alternate aspects incorporating any type of ancillary game subject only to logical preclusion of any particular type of ancillary game by other specifically-disclosed aspects of such example. Optionally, an ancillary game may be triggered by a predetermined event in another ancillary game (e.g., a bonus game being triggered within a secondary game). The predetermined event can comprise any displayed symbol or displayed combination of symbols arranged along a pay-line or along multiple pay-lines or it may comprise any displayed symbol or displayed combination of symbols in a scattered arrangement about reels 14, 16, 18, 20 and 22. The predetermined event is arbitrary and may comprise any event or combination of events, such as alignment of a plurality of symbols along a pay-line comprising a wager. The predetermined event may even include a "non-winning" event (i.e., no coins or credits dispersed to the player).

In some embodiments, the player is only eligible for the ancillary game (e.g., bonus game) if the player chooses to play all of the pay-lines and/or the player wagers the maximum amount on each of the pay-lines played. In other embodiments, the player may only become eligible to play the ancillary game (e.g., bonus game) after satisfaction of a predetermined minimum contribution has been made by that player to at least one of the bonus prize in the bonus game, such as determined through the player's use of conventional player identification devices (e.g,. hospitality card), identification number or other identification information (e.g., casino hotel room number). In still other embodiments, the player is automatically eligible for the ancillary game (e.g., bonus game), and is not required to make a minimum wager or to play a minimum number of lines.

As one example, a special "start bonus" outcome occurs in the basic game when a winning combination of three or more "DICE" symbols in the basic game, such as shown along pay-line 80 in FIG. 4. This "start bonus" outcome causes the CPU 70 to execute a game control instruction which enters a bonus game.

FIGS. 4-6*e* relate to an implementation of the present concepts in an ancillary-game having a board-game theme. The present concepts are not limited to a board game or to any particular board game. The ancillary game in the example may comprise, by way of example, a bonus game and/or progressive game, but is not to be limited thereto. In the ancillary game in accord with the present concepts at least one award is initially locked, unlocked the locked award when a player satisfies a first predetermined event, and awarded to a player satisfying a second predetermined event. The player satisfying the second predetermined event need not be the same player satisfying the first predetermined event and the first and second predetermined events need not comprise the same event or same type of event.

In one aspect, the bonus game(s) may comprise a plurality of simultaneously occurring single level and/or multi-level bonus games, accessible to a player. In one aspect, each of these single level and/or multi-level bonus games has unique characteristics differentiating it from the remainder of the other bonus games, but possesses at least one unifying characteristic with the remaining games (e.g., a common theme). In this latter aspect, the common theme may be a board game wherein a plurality of spaces on the game board, or alternatively each space on the game board, comprises a distinct bonus game. As a player moves across the game board a pre-determined number of squares (i.e., a random number) to land on a square indicated by such pre-determined number, the player will enter the bonus game corresponding to that square.

In one embodiment, the ancillary game is a bonus game having a board-game (e.g., MONOPOLY®) theme and is implemented on the top box game board 62 and video display 12. The board game defines a plurality of stations or squares about a game board traversable by a game token, or token "identifier" indicating the position of a token, or player. For example, a token "identifier" comprises in one embodiment an illuminated station of the top box game board 62 indicating the position of a token, or player otherwise not displayed on the top box game board 62. Hereinafter, references to displaying the position of a token, or player, shall be understood to mean the display of either an actual game token or a token identifier on a displayed game board or portion thereof.

Figure 5:
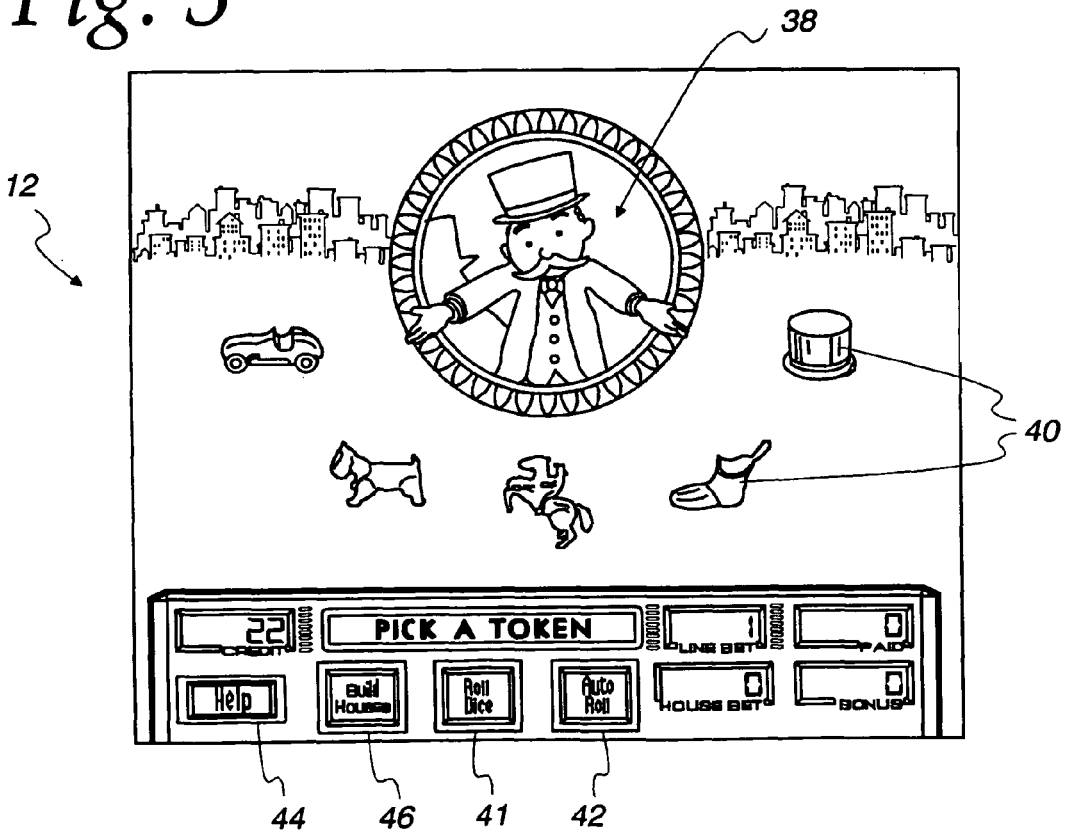
FIG. 5 is an illustration of a "Pick Token" screen which appears on the video display of the gaming machine of FIG. 1 according to one aspect of the disclosure.

In the aforementioned aspect, upon initially entering the ancillary game (e.g., a bonus and/or progressive game), the CPU 70 operates to replace the display of reels 14, 16, 18, 20, 22 on video display 12 with a token selection screen (FIG. 5) offering a selection of board game tokens 40. As shown in FIG. 5, the token selection screen may display an animated Rich Uncle Pennybags symbol 38 above a selection of MONOPOLY® tokens 40 (e.g., "CAR," "DOG," "HORSE," "SHOE" and "HAT"), and the player is prompted to select one of the game tokens 40. In one embodiment, the video display 12 comprises a touch-screen display and the selection of a game token 40 is accomplished by touching the desired token on the display 12. It will be appreciated, however, that any of several known player control or data input devices may be used to implement the selection of a token 40. In another embodiment, the player scrolls through the tokens 40 and selects a particular token by depressing a designated "select" button on the gaming machine 10 when the desired token 40 is highlighted. Scrolling through the tokens 40 prior to the selection of the desired token may be controlled by the game program or by the player.

Once the player selects a token 40, the CPU 70 operates to display a portion of the game board on the video display 12 with the selected token on a starting station of the game board. The CPU 70 also signals I/O controller 71 to illuminate the starting station on the top box game board 62. For example, if the starting station is the "GO" square, the CPU 70 may be adapted to display the selected MONOPOLY® token on the GO square of a scrolling video MONOPOLY® board on the video display 12 and also signal I/O controller 71 to illuminate the GO square on the top box MONOPOLY® board 62.

CPU 70 or another local or remote random number generator selects an integer movement value defining a number of stations or steps which a player's token is to be moved from the selected starting square and/or from subsequent squares denoting positions during game play, as appropriate to the particular game. In one embodiment, the player "rolls" a pair of dice by touching a "Roll Dice" key 41 or "Auto Roll" key 42 on the video display 12 (see, e.g., FIG. 5). The outcome of each roll (e.g., the integer movement value) is determined by the CPU 70, which then issues game control instructions to display indicia of the pre-determined "roll." On the top box display 32, movement of the player's token during game play may be illustrated by the illumination, in step-wise fashion, of the appropriate stations (squares) on the game board 62 (e.g., MONOPOLY board) from the previous position to the position determined by the roll of dice. If the top box display 32 comprises a video display, a state of a plurality of player's tokens may be simultaneously and distinctly represented. On the video display 12, movement is illustrated by movement of the selected game token 40.

The gaming machine 10 may be connected to a bonus game into which more than one gaming machine is linked, as will be described below. In one aspect, a plurality (e.g., several) of gaming machines 10 of the type described above, may be cooperatively linked together. Signage and/or displays may also be disposed adjacent to or in the vicinity of the linked gaming machines to display aspects of the ancillary game to prospective players.

In one aspect, the ancillary game may comprise a multi-level bonus game wherein one or more of the 22 property squares comprising the MONOPOLY® game board (e.g., BALTIC AVENUE, VERMONT AVENUE, VENTNOR AVENUE, PARK PLACE, BOARDWALK) form individual bonus games having five bonus prize levels and a zero or "no house" condition. The five bonus prizes include one house, two houses, three houses, four houses, and a hotel, the hotel being equivalent, in one aspect, to five houses. Additional levels may also be added corresponding to hotel plus one house, hotel plus two houses, etcetera, up to a predetermined number of hotels (e.g., 2 or 3). Satisfaction of the conditions precedent to an award of the "hotel" bonus resets the bonus level for the respective property square back to "no house" or "one house," as desired.

The bonus prizes are awarded to a respective one of the multiple players upon occurrence of a certain bonus prize-win event initiated by such player. The bonus prize is then "leveled-up" to the next successive bonus prize level. A subsequent player, who may be the same player who triggered the prior bonus prize-win event or may be another player, then has the opportunity to benefit from the leveled-up bonus prize.

Alternately, the bonus prizes are merely "unlocked" or made available following a player's satisfaction of a certain bonus prize-unlocking event initiated by such player. The bonus prize is available to the next player who satisfies a bonus prize-win event, at which time the bonus prize is "leveled-up" to the next successive bonus prize progressive level. This sequence of unlocking and winning continues through the remaining bonus prize levels. Although the individual unlocking the particular bonus prize in this aspect may not be the recipient of the actual bonus prize, other awards may be dispersed to such player including nominal coin or credit awards or free turns.

Figure 6:
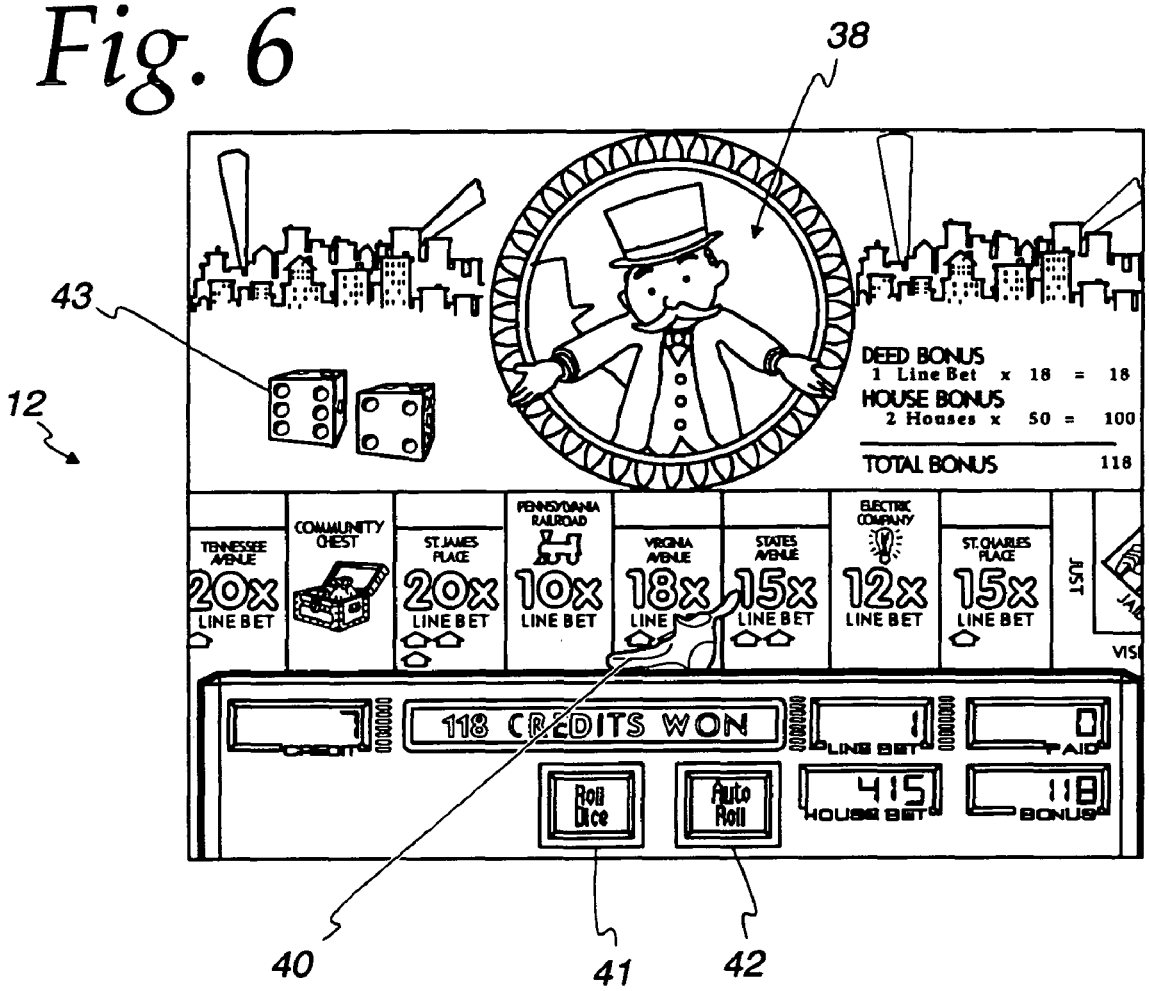
FIGS. 6 and 6A-E are, examples of aspect of bonus round play with respect to the gaming machine of FIG. 1 in accord with at least some aspects of the disclosure.
Figure 6A:
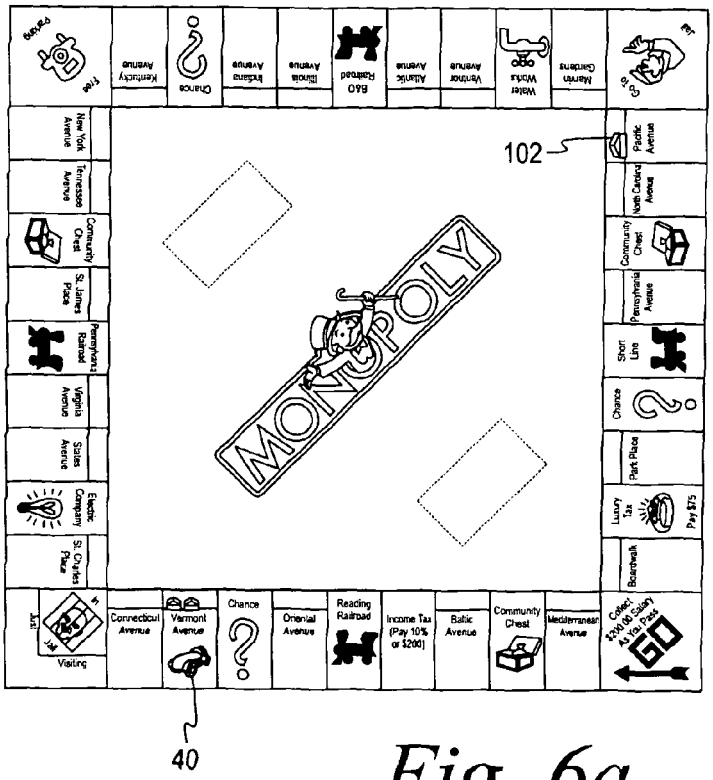

In one aspect, whether or not an award is provided for an amount indicated on the property multiplied by the line bet, a bonus prize may be awarded in an amount equal to the indicated property value times the number of houses or hotel(s) on the property, or in some other amount or in accord with some other scheme. As one example, a player "rolls" an "8" on the first roll and a token 40 representing the player on lands on VERMONT AVENUE, as shown in FIG. 6*a*. In this example, landing on the VERMONT AVENUE property square is itself a bonus prize-win event. From preceding play by the same player or by other players, two houses 101 are already present on VERMONT AVENUE and the price for the VERMONT AVENUE is shown to be $100, as in the conventional MONOPOLY®. In one aspect, this price may be multiplied by 2 (2 houses×$100) to provide a bonus prize payout of $200 or 800 credits. These amounts are arbitrary and are merely intended to reflect the events themselves and the leveling-up of the bonus prize, not to reflect any limitations on the structuring of the award. In one aspect, for example, this indicated value may be multiplied by a percentage of the players line bet relative to a maximum possible line bet. For example, a one quarter bet is 20% of the potential maximum bet (e.g., 5 quarters) for the pay-line or set of events that triggered entry into the bonus game. Thus, in this example, a player whose entry into the bonus game was based on a two quarter bet, the bonus prize payout would be $80 ($200×40%) or 320 credits. A maximum bet would therefore yield a bonus prize payout of $200 in this example.

The bonus prize award may be a persistent state sequential award having a plurality of different states or values. For example, a first level of the award could comprise 10 credits, a second level 20 credits, a third level 30 credits, and so on. The progression in state need not be linear and could, for example, increase by a multiplier rather than a set increment.

Figure 6B:
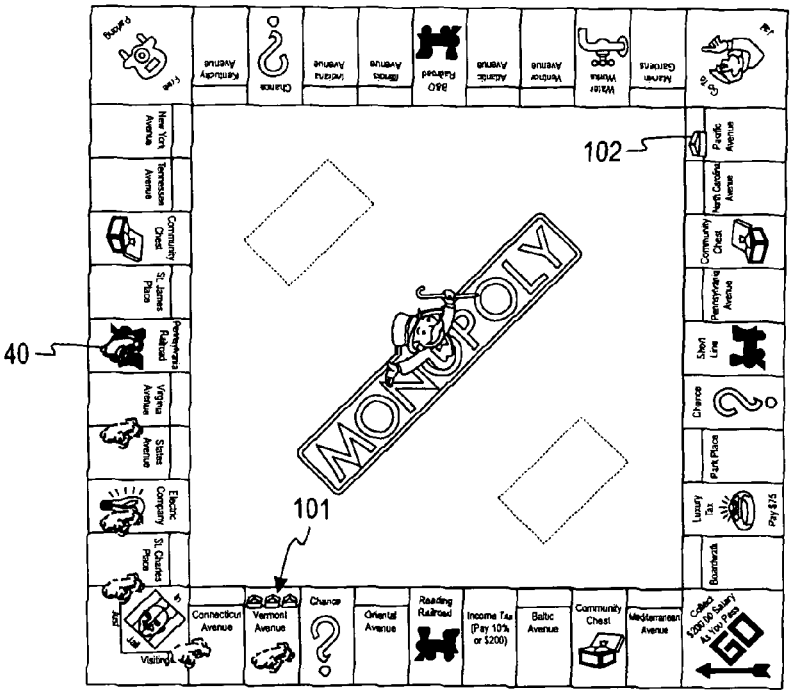

Since the player satisfied the bonus prize-win event for that particular property, the bonus prize is incremented or leveled-up to the next successive bonus prize level and the player leaves the property with three (3) houses 101, not 2 houses, such as is shown in FIG. 6*b*. Thus, a subsequent participating player landing on VERMONT AVENUE will reap the benefit of the prior player's "leveling-up" of the bonus prize. This bonus prize-win event may be generally applied to all 22 properties on the game board. Alternatively, the bonus prize-win event may be applied only to a selected subset of the properties on the game board (e.g., all properties having a particular color or unifying theme), or to a specific property, based on satisfaction of one or more arbitrary events (e.g., influenced by game play), setting of a variable by the owner of the gaming console 10 (e.g., influenced by owner), or may be immutable (e.g., fixed by software).

Figure 6C:
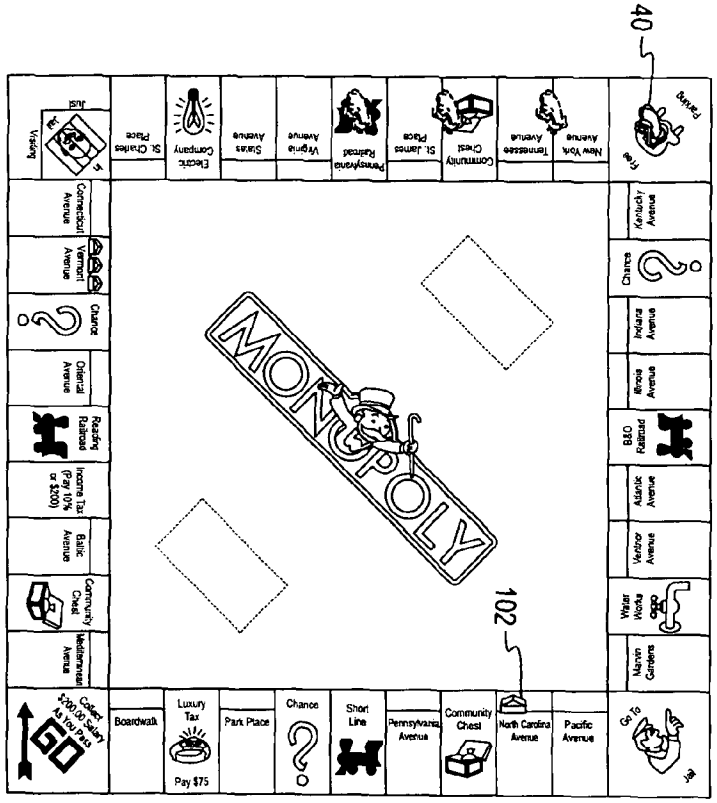
Figure 6D:
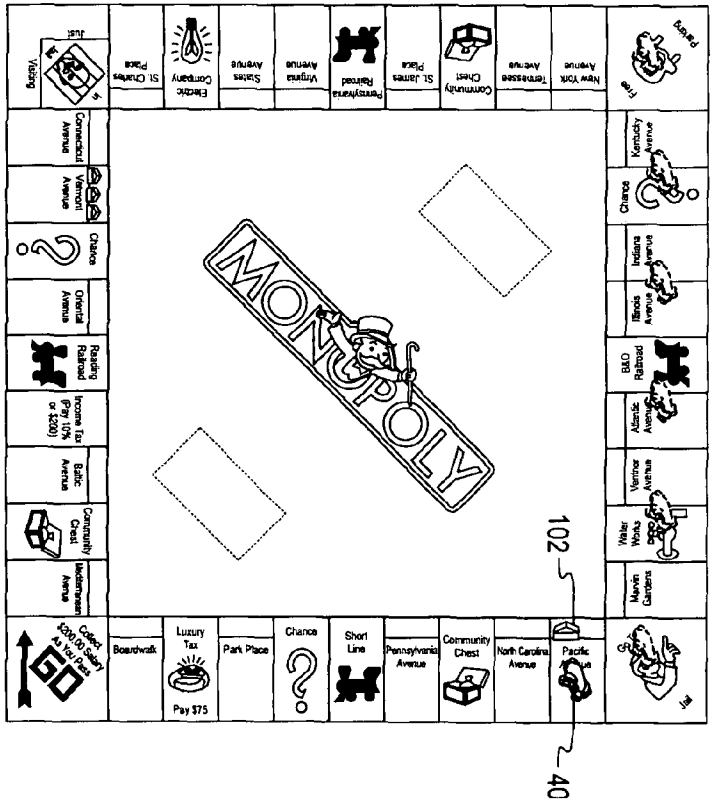

Continuing with the example above, the player then rolls again, rolling a "7" in a second roll, and the player's token 40 is moved to PENNSYLVANIA R.R., as represented by the movement of the token from VERMONT AVENUE to PENNSYLVANIA R.R., as represented in FIG. 6*b*. In this example, the PENNSYLVANIA R.R. square does not trigger a bonus prize-win event, but may optionally trigger another arbitrary reward event (e.g., +100 credits). A third "roll" by the player, a "5", such as shown in FIG. 6*c*, moves the player's token 40 from PENNSYLVANIA R.R. to "FREE PARKING," which likewise does not trigger a bonus prize-win event but may optionally trigger an arbitrary reward event (e.g., +150 credits). A fourth "roll" by the player, an "11", moves the player's token 40 to "PACIFIC AVENUE," such as represented in FIG. 6*d*, and would trigger another bonus prize-win event for the PACIFIC AVENUE property. In this example, the PACIFIC AVENUE property may already have a hotel 102 on the property and may, in various exemplary aspects, payout $1500 or 6000 credits (hotel (5 houses)× $300), a percentage thereof based on a percentage of a maximum line bet played (e.g, 40% of maximum award for a two credit initial wager resulting in a payout of $600 or 2400 credits), or some other predetermined award level (e.g., 1500 credits). In accord with the above, following satisfaction of the highest bonus prize-win event (e.g., landing on a property with a hotel), the bonus prize for that property is reset to a base level (e.g., no house or one house).

Figure 6E:
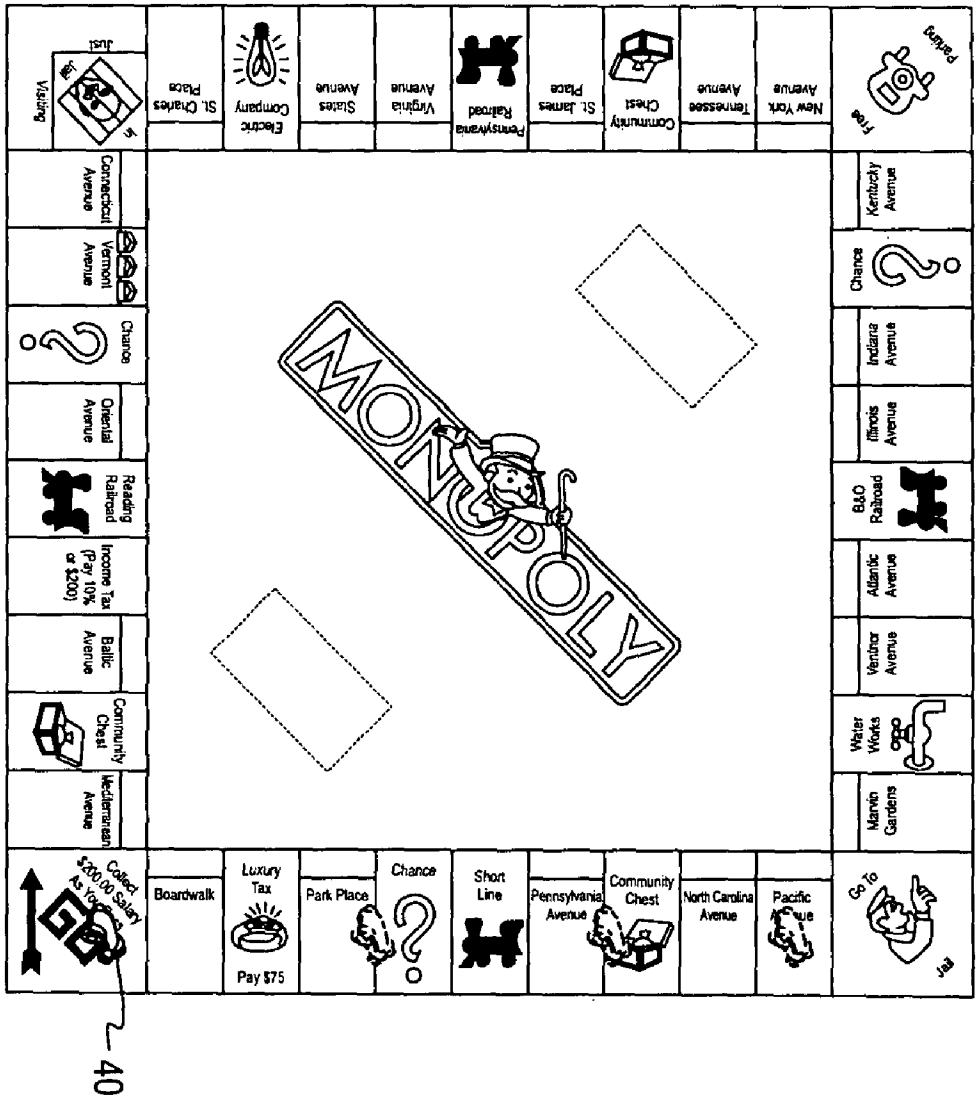

A final, fifth roll by the player is a "10," represented in FIG. 6*e*, takes the player's token 40 off the gaming board and out of the bonus game of the present example (i.e., MONOPOLY® ONCE AROUND™). In this embodiment, the bonus game thus continues with consecutive rolls of the dice, with the player collecting various amounts corresponding to the landing properties determined by the rolls of dice, until the player's token has completed one trip around the game board. If the rolls are initiated by pressing the "Roll Dice" key 41, the game will pause between rolls until the player touches the key 41 or 42. If the rolls are initiated by the "Auto Roll" key 42, the CPU 70 causes the dice to roll automatically after a small delay following the previous roll. Although FIGS. 6*a-e* show one representative game element 40 moving around a game board, any number of game elements representing different players may be simultaneously moving around the game board, dynamically changing the game board, with new game elements and players entering, playing, and exiting the game.

In one aspect of the game, landing on the "CHANCE" or "COMMUNITY CHEST" squares during the bonus game triggers, through CPU 70, an animation on video display 12 which shows the top card of a pile of cards flipping up to reveal the "CHANCE" or "COMMUNITY CHEST" outcomes, much as indicated by U.S. Pat. No. 6,315,660.

In another aspect, the progressive jackpots are merely "unlocked" or made available following a player's satisfaction of a certain bonus prize-unlocking event initiated by such player, rather than constituting a bonus prize-win event, as provided in the above example. In this aspect, the bonus prize is available to the next player who satisfies a bonus prize-win event, at which time the bonus prize is "leveled-up" to the next successive bonus prize. This sequence of unlocking and winning continues through the remaining bonus prize levels. In the above example, the player "rolls" an "8" on the first roll and lands on VERMONT AVENUE, which comprises a bonus prize-unlocking event. A subsequent player landing on VERMONT AVENUE could then satisfy the bonus prize-win event (e.g., landing on the square itself, or landing on the square with a certain numerical roll or sequence), which would increment or level-up the bonus prize. Continuing, the player rolls a "7" in a second roll, ending up on PENNSYLVANIA R.R. A third "roll" by the player, a "5", places the player on "FREE PARKING". A fourth "roll" by the player, an "11", places the player on "PACIFIC AVENUE" and would comprise another bonus prize-unlocking event for the PACIFIC AVENUE property. A subsequent player landing on PACIFIC AVENUE could then satisfy the bonus prize-win event, whatever it may be, to win the jackpot and to increment or level-up the bonus prize to the next successive bonus prize level. A final, fifth roll by the player is a "10," which ends the bonus game.

Numerous other aspects of the above concepts are possible. As one example, the multipliers displayed on each property (e.g., VERMONT AVENUE displays a base 10× multiplier) may be incremented upwardly by a predetermined amount in individual bonus games having a desired number of bonus prize levels, such as but not limited to: 1.2×base multiplier (12× for VERMONT AVENUE), 1.4×base multiplier (14× for VERMONT AVENUE), 1.6×base multiplier (16× for VERMONT AVENUE), 1.8×base multiplier (18× for VERMONT AVENUE), and 2.0×base multiplier (20× for VERMONT AVENUE). The resulting multiplier is then applied to the standing line bet of the player, as modified by any potential side bets placed by the player. In this example, with no side bets and a four credit (e.g., four quarter) bet, a 20× bonus prize event (e.g., landing on VERMONT AVENUE after prior players, which could include the present player, landed on VERMONT AVENUE a sufficient number of times to rotate the bonus prize to the 2.0×base multiplier level) yields 80 credits.

In still other aspects, the MONOPOLY® ONCE AROUND™ concept could be replaced by any other MONOPOLY® variants. For example, a player may receive only one roll from a random starting position. The player may even be provided with options for attempting to influence the starting position selection by investing additional credits to enhance the odds of eliminating undesirable starting positions (e.g., GO or BOARDWALK) or of being located within rolling distance of high value properties such as PARK PLACE and BOARDWALK. The most undesirable starting points could correspondingly require the greatest monetary input by the player to avoid such properties. In another example, the player may be permitted to continue rolling until the player lands on a property. In such instance, a player may be fortunate enough to land on READING R.R., COMMUNITY CHEST, WATER WORKS, and then BOARDWALK on successive rolls of the dice.

In yet another aspect, a player in the bonus game may be initially be disposed on the GO station and may be permitted a single roll of the dice to determine on which subsequent station or property the player's game piece will land. In this variant, the player's line bet for a selected pay-line (e.g., a winning pay-line or a "start progressive" event pay-line) may influence, proportionally or non-proportionally, a number of stations or properties in the bonus game which might be randomly selected to permit an additional or free roll for that individual player to thereby permit advancement by that player to more desirable and profitable areas of the game board. As one example, if a single credit is wagered on the pay-line selected by the computer or gaming software, the player may get no additional opportunities for an additional or free roll. However, if nine credits are wagered on the pay-line selected by the computer or gaming software, the computer or gaming software will randomly designate 9 of the 40 stations or properties as enabling an additional roll of the dice by the player. These stations or properties enabling an additional roll of the dice by the player may be hidden to the player or may be revealed to the player prior to the player's initial roll of the dice. Thus, players would be motivated more strongly to increase the initial line bets for one or more pay-lines so as to enhance the odds of achieving a larger payout in a subsequent bonus game.

In still another aspect, a player in the bonus game may be initially be disposed on the GO station and may be permitted a single roll of the dice to determine on which subsequent station or property the player's game piece will land. In this variant, the player may be invited to insert an additional number of credits or coins, up to a predetermined limit (e.g., 9) which could be any number less than the available number of stations on the game board, to add into the game board for that individual player a number of stations or properties in the bonus game which might be randomly selected to permit an additional or free roll to thereby permit advancement to more desirable and profitable areas of the game board. As one example, if the player wagers a two additional credits, the player may get one additional opportunity for an additional or free roll (i.e., one randomly selected station or property is selected to enable an additional roll). In this example, VIRGINIA AVENUE might be the randomly selected additional roll property. Unless the player is able to land on CHANCE and obtain a free roll from a randomly selected CHANCE card, the additional roll will be unavailable to that player as simply being out of reach. However, if ten credits were to be wagered the player may get five opportunities for an additional or free roll (i.e., five randomly selected stations or properties are selected to enable an additional roll). In this example, VIRGINIA AVENUE, VERMONT AVENUE, ILLINOIS AVENUE, ST. CHARLES PLACE, and WATER WORKS might be the randomly selected additional roll stations or properties. If the player is able to roll an "8" from GO, the player will win whatever award might accrue from landing on VERMONT AVENUE, as well as obtaining an additional roll of the dice or turn. Likewise, if the player was then able to roll a "3" to land on ST. CHARLES PLACE or a "6" to land on VIRGINIA AVENUE, then the player would again win whatever award might accrue from landing on said property, as well as obtaining an additional roll of the dice or turn. This aspect encourages the player to place additional bets during the bonus game and correspondingly provides enhanced opportunities for continued play as well as higher potential payouts as the player advances across the game board to more desirable areas of the game board.

In still other aspects, the award (i.e., the bonus prize) may be made unlocked, as described above, but may only be made accessible for a bonus prize-win event upon the occurrence of a doubled roll of the dice (i.e., 1-1, 2-2, 3-3, 4-4, 5-5, and 6-6). Using the above example, the player may start at GO and roll a "4-4" to land on VERMONT AVENUE. The occurrence of the "4-4" may itself be sufficient to constitute a bonus prize-win (assuming the property bonus prize has already been previously unlocked) event with corresponding benefits, as noted above, to the player and/or subsequent players. Alternatively, the bonus prize-win event could be still more restrictive and could require satisfaction of not only a doubled roll of the dice, but a particular sequence within such doubled roll of the dice. In other words, a bonus prize-win event would be rolling a 1-1 to land on a particular property (e.g., VERMONT AVENUE). Other rolls, such as a 3-5, 6-2, or 4-4 would not, however, constitute a bonus prize-win event, but may provide some other tangible benefit. Once a player has landed on the property with a 1-1, the bonus prize-win event is rotated or incremented to a 2-2, which may be satisfied only when a player's game piece lands on the property with a roll of 2-2, and so on. Upon satisfaction of the bonus prize-win event, the player causing such event is awarded the bonus prize, such as described above, and the bonus prize is again "locked". Although this seems restrictive, multi-player gaming with numerous participants can produce a large number of rolls in short time periods, with a correspondingly higher probability of having a number of such players attaining such double rolls.

The value of the bonus prizes may be adjusted to take into account the odds of unlocking any such bonus prize, with higher jackpots or awards being awarded to less likely events and lower bonus prizes being awarded to more likely events.

The number of participating players or machines may be open or may be manipulated, provided a sufficient minimum number of players, to maintain a substantially fixed number of players for a particular game. In one aspect, entry into the game may itself be controlled. In another aspect, in an open entry gaming scenario, too many players may enter an on-going game and accelerate game play to an undesirable level, in which case, a number of players may be designated to separate into another game which may, at least initially, replicate the persistent states of the game board stations at the instant of separation so that no individual player is biased by the separation. In other words, all available award opportunities are still available to the removed players upon continued play and any potential side bets would also be carried over into the new game. Such manipulation of game playing group size is of particular benefit during extremely active periods of game play.

In still another aspect, a plurality of separate ancillary games may be ongoing at any particular time and a player at a gaming terminal, once granted entry to an ancillary game by satisfaction of a predetermined event, may be permitted to choice which of a displayed selection of available ancillary games he or she would wish to join. Status, payout, and historical information on the available ancillary games can be provided to assist the player in making a decision, or the groups could simply be denoted by characterizations in line with that of the underlying game theme.

In each of the above aspects, the players might be awarded an additional amount resulting from a side bet or side-wager, if any, associated with the property. Such side bets may take any form commensurate with the game play and are described, in various aspects, in U.S. patent application Ser.

No. 10/659,878, filed on Sep. 11, 2003, entitled "Gaming Machine With Multi-Level Progressive Jackpot," which is commonly owned and is herein incorporated by reference in its entirety. A side bet may be placed by a player as a bet that the player may satisfy a predetermined condition in an upcoming roll (e.g., to roll a 1-1 or to land on a specified station or property) or may be placed by a player as a bet that another player may satisfy a predetermined condition in an upcoming roll (e.g., to roll a 1-1 or to land on a specified station or property).

In one aspect, side bets may be placed on the stations or properties of the game board which the player predicts will be landed on during the ancillary game, separate and apart the coins or credits wagered in the basic game. The increments of the side bets which may be made on the various properties and stations may be varied according to the game program. In one aspect, for example, the player may be given the opportunity to "build" houses (make side bets) on the properties of the MONOPOLY board which the player predicts will be landed on in a subsequent roll during the ancillary game. The amount of the side bet corresponds to the "cost" of the houses built on the various properties, which generally varies according to the property selected. The mechanics of this approach may generally correspond to that shown in U.S. Pat. No. 6,315,660, which is incorporated herein by reference. In such side bets, the cost of the side bet is subtracted from the credits previously earned or paid into the machine by the player upon the "roll" of the dice. Then, the CPU 70 executes a game program, selecting integer movement values corresponding to a roll of dice to advance the game token, or token identifier along the game board. CPU 70 then compares the true position to the predicted position(s) and, if the true position matches any of the predicted position(s), the player is paid an amount of coins or credits, as appropriate, corresponding to the side bet and any designated outcome for such side bet.

The above concepts may also be applied to a progressive game, wherein a percentage of coin-in data from a participating gaming device(s) is contributed to a jackpot amount and the jackpot is awarded to a player upon occurrence of a certain jackpot-win event. In one aspect, each property square in the board game may comprise a separate progressive game. In accord with the above concepts, the progressive may also include multiple levels. In one example thereof, the percentage of a participating gaming device(s) coin-in data that is to be contributed to a jackpot amount or between jackpot amounts may be evenly divided between the progressive jackpots and may optionally be preferentially distributed to a higher one of the progressive jackpot levels. The dedicated coin-in data amount is generally between about 1%-25% of the wager, and is preferably between about 1-5% of the wager or even between about 1-2% of the wager. However, to facilitate excitement and game play, the dedicated coin-in data amount may be increased to still higher amounts, such as 30, 40, or 50% of the wager for particular aspects of the game play or upon attainment of certain milestones by the player. In one aspect, the dedicated coin-in data amount may correspond to the size of the wager, with larger percentages within any of the noted ranges or even across ranges corresponding to larger wagers or to the history of a particular player's play during that game or the history of a player's play within a casino (e.g., to reward loyalty and past wagering).

In one aspect, of the above-noted dedicated coin-in data amount, 5% may be applied to a first progressive jackpot level, 5% may be applied to a second progressive jackpot level, 10% may be applied to a third progressive jackpot level, 30% may be applied to a fourth progressive jackpot level, and 50% may be applied to a fifth progressive jackpot level. Thus, the higher properties may optionally receive a larger share than the lower properties. In this aspect, the jackpot amount for the highest level are heavily funded, relative to the other jackpot levels. In another aspect, the funding of the higher jackpot levels (e.g., fifth progressive jackpot level) may be deemphasized relative to the other jackpot levels if the likelihood of any player attaining such higher jackpot level is sufficiently remote.

In other aspects of the present concepts, the ancillary game may be implemented in other non-board game themes, such as cards, dice, or slots.

Figure 7:
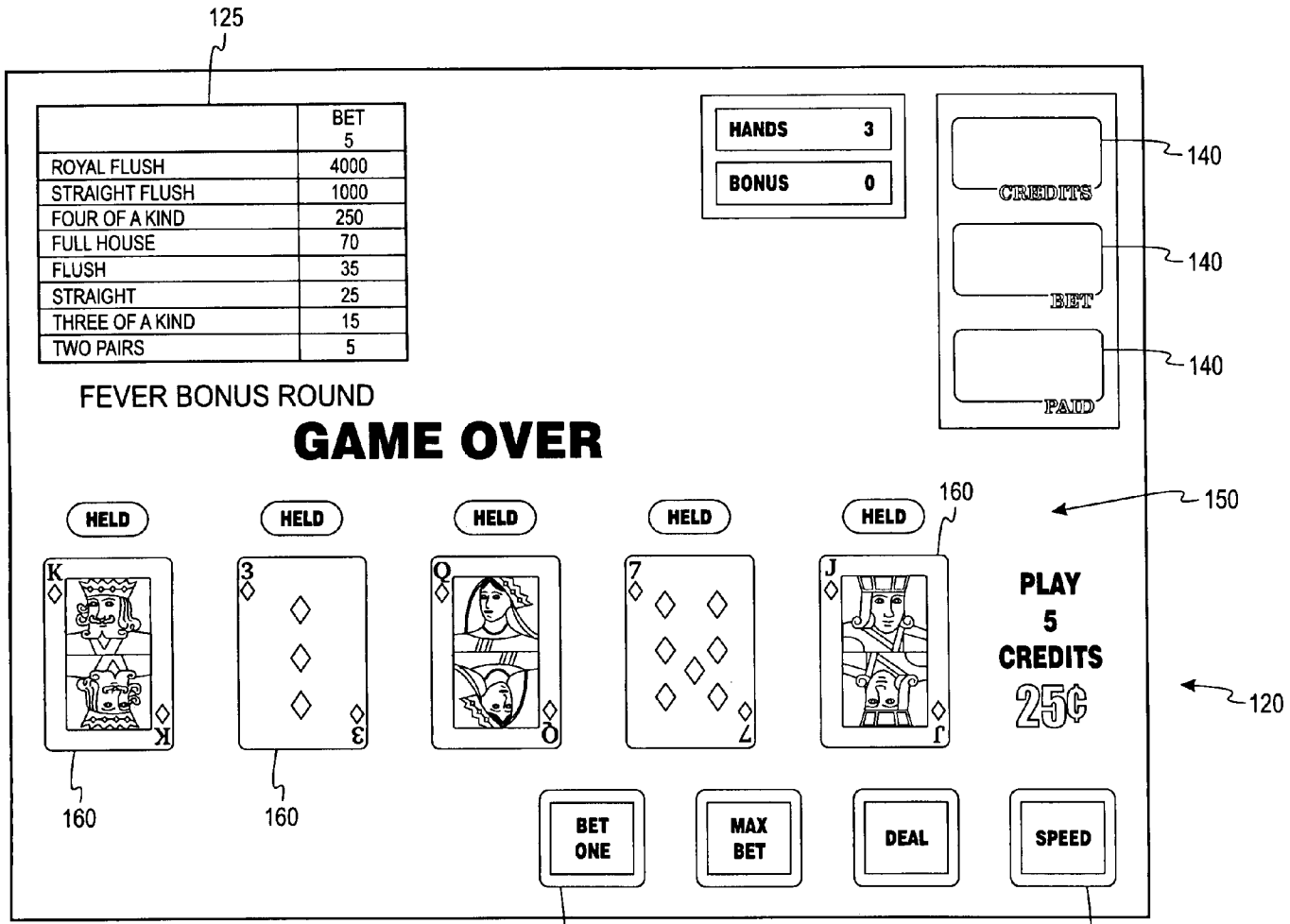
FIG. 7 illustrates a screen-shot of a video poker game which may implement the present concepts.
Figure 8:
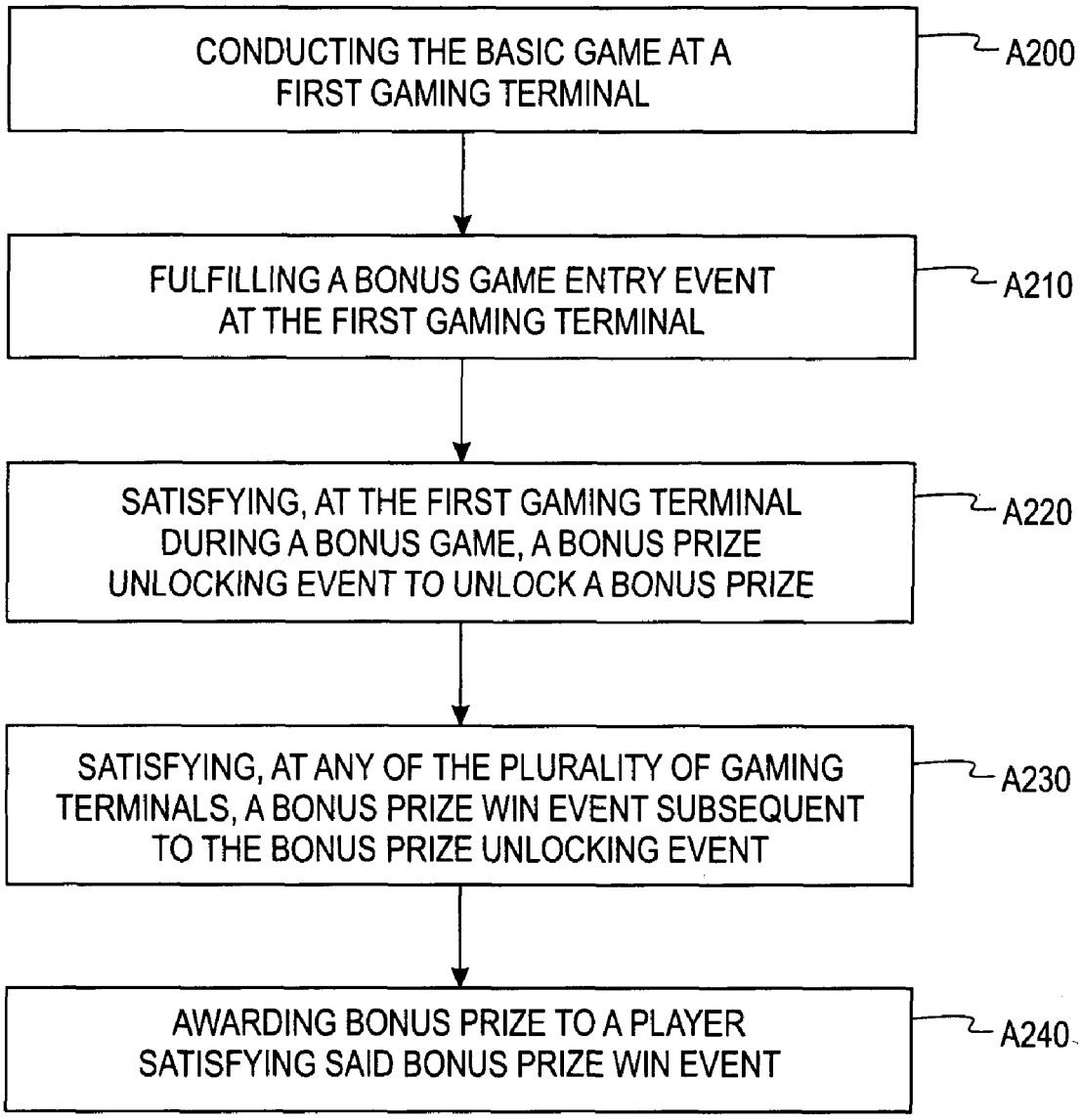
FIG. 8 depicts a method of playing a wagering game in accord with at least some aspects of the present concepts.

FIG. 7 illustrates a screen-shot of a video poker game which may implement the present concepts and more generally depicts an example of a cards-based video wagering game. A gaming machine includes a display 120 comprising a dot matrix, CRT, LED, LCD, electro-luminescent display or any other type of video display. The display 120 may optionally double as a data input device (e.g., a touch-screen). A control system, inclusive of a CPU or processor and associated hardware, software or firmware, similar to that shown in FIG. 2 and described above, is provided to operate the gaming machine and other gaming machines to which gaming machine is connected. Coin/credit detectors, game activation switches, levers, buttons, icons, etc. are provided, as described above, to enable wagering, initiation of game play, maintaining of game play, and response to options provided by the control system.

As shown in FIG. 7, the gaming control system operates to display a basic game comprising a payout table 125, a plurality of input devices 130 (e.g., buttons "Bet One", "Max Bet", and "Deal"), informational units 140 (e.g., showing credits, bets, speed, and the like), and a hand 150 of cards 160. In the illustrated aspect, the cards 150 are taken from a standard playing card deck including conventional denominations and suits. Moreover, the illustrated aspect depicts a five-card poker wagering game. Other card games and other types of poker games are included within the present concepts.

A basic game might be played by pressing the "Deal" button 130 following input of a wager. A hand 150 of playing cards 160 are displayed on the display 120 and, typically, the player is given the option of which cards, if any, the player wants to discard in favor of an additional draw to replace those discarded cards. In the basic wagering game, the player receives a payout only on a winning combination (e.g., two pair, three of a kind, straight, flush, full house, four of a kind, straight flush and royal flush).

One or more predetermined events, which may or may not comprise a winning combination in the basic game, may direct the player into an ancillary game. The ancillary game may advantageously comprise a bonus game or a progressive game of the same type of game or a different type of game. The progressive game may be specific to each gaming terminal 10, or may comprise a progressive game linked to a plurality of gaming terminals. The predetermined events for entry into the ancillary (e.g., progressive) game may comprise any winning combination, such as three of a kind or higher, or may comprise the display of a particular card 160, denomination, or suit, or combination thereof unrelated to a winning combination.

In one aspect, the ancillary game is a multi-level progressive game having eight progressive jackpot levels consisting of: (1) one pair of Jacks or better, (2) two pairs, (3) three of a kind, (4) straight, (5) flush, (6) fall house, (7) four of a kind, and (8) royal flush. Satisfaction of one of these progressive jackpot levels constitutes either a jackpot-win event or a jackpot-unlocking event, as discussed below. Once the jackpot-win event is fulfilled, the progressive jackpot is incremented to the next highest level, with the exception of the royal flush, which resets the progressive jackpot back to one pair of Jacks or better, or other jackpot level.

A percentage of a participating gaming device(s) coin-in data is contributed to at least one of the eight progressive jackpots. The coin-in data may include or may exclude, line bets and/or side bets, if any, placed during the progressive game. The percentage of a participating gaming device(s) coin-in data to be contributed to any of the eight progressive jackpots may be varied by the gaming control system (e.g., in accord with a predetermined instruction set) so as to improve playability, increase excitement, or to simplify accounting.

The implementation of the present concepts in a video-based poker progressive game is advantageously tied to a networked-gaming platform comprising a plurality of gaming terminals 10 linked either to one another or linked to a centralized or distributed computer or controller, which may or may not be locally resident. The progressive jackpots are awarded to a player at a respective one of the plurality of gaming terminals 10 upon occurrence of a certain progressive jackpot-win event initiated by such player. The progressive jackpot is then "leveled-up" to the next successive progressive jackpot progressive level. A subsequent player, who may be the same player who triggered the prior progressive jackpot-win event or may be another player, then has the opportunity to benefit from the leveled-up progressive jackpot.

In another aspect, prior to enabling the awarding of a progressive jackpot to a player, the progressive jackpot must be "unlocked" or made available upon the satisfaction of a predetermined progressive jackpot-unlocking event. Following such unlocking of the progressive jackpot, the progressive jackpot is available to the next player who satisfies a progressive jackpot-win event, at which time the progressive jackpot is rotated or "leveled-up" to the next successive progressive jackpot progressive level. Thus, for example, a player who first satisfies the "full house" condition following fulfillment of the "flush" progressive jackpot win event may unlock the "full house" jackpot-win event for later satisfaction by the player or by another player. This sequence of unlocking and winning continues through the remaining progressive jackpot levels. Although the individual unlocking the particular progressive jackpot in this aspect may not be the recipient of the actual progressive jackpot, other awards may be dispersed to such player including nominal coin or credit awards or free turns.

In one aspect, since the statistical odds of obtaining royal flush are fairly low, the progressive jackpot may be reset to a lower level, or the lowest level, after a certain period of time has lapsed, so as not to hang up the progressive game. For example, after 6 hours after the satisfaction of the four of a kind jackpot win event wherein the royal flush jackpot win event remains unfulfilled, the progressive game jackpot could start cycling backwards (e.g., back to the full house level, setting the four of a kind jackpot as the current progressive jackpot. This retrogression of the progressive jackpot may occur at any level to promote maintenance of game inertia. For example, if few people are playing, or if many people are playing lackadaisically, the progressive jackpot, following a satisfaction of the full house jackpot-win event one hour earlier, may revert back to the flush level and reset the jackpot-win event to the full house condition, with a continued retrogression if warranted.

As described above with respect to the preceding example, the progressive jackpot levels may be sequentially won, each progressive jackpot win being accompanied by an incrementing or advancement of the progressive jackpot. Alternatively, the progressive jackpot levels must be sequentially unlocked and then won in a subsequent event, each progressive jackpot win being accompanied by an incrementing or advancement of the progressive jackpot. Thus, a player receiving a "straight flush" when the progressive level is at a "flush" level will not satisfy either a progressive jackpot unlocking event or a progressive jackpot win event, as the winning combination does not comport with the then current progressive jackpot level. However, awards or prizes other than the progressive jackpot may certainly be paid out for such winning combinations. Certain combinations, such as a royal flush could be optionally designated as trumping or winning without satisfying the sequential progression of progressive jackpot levels.

Alternatively, the present concepts may be utilized in a conventional mechanical or video-based slots game, such as illustrated in FIG. 4. A basic game is played by spinning the reels 14, 16, 18, 20 and 22 in a gaming terminal 10. If any combination of symbols on a selected pay-line (e.g., pay-line 76) constitute an award unlocking combination, an award is unlocked. Following such unlocking of the award, the same or another combination of symbols on the same pay-line or on another pay-line may constitute an award-win event. Thus, it is not necessary that the present concepts be implemented, for example, in an ancillary game.

In another aspect of the slots concept, a plurality of award levels are provided for various combinations of symbols on a selected pay-line containing a wager. The award level generally increases with decreasing probabilities of satisfying the award. Unlocking of an award and subsequent satisfaction of the award-win condition increments the award to the next higher award level, if any, or resets the award level to the base award if the highest award was just paid out. These slots concepts are applicable to any gaming machine comprising a slots game or slots-type game including, for example, progressive-game based gaming terminals. In one aspect, the progressive jackpot could itself be the highest award level and a plurality of other awards could be awarded, following requisite unlocking events, before permitting players to compete for the progressive jackpot, unlock the progressive jackpot, and subsequently win the progressive jackpot, at which time the award is set to the base level and the coin-in data is again used to replenish the progressive jackpot.

While the present concepts have been described with reference to one or more particular embodiments, those skilled in the art will recognize that many changes may be made thereto without departing from the spirit and scope of the present concepts. For example, the present concepts may be applied to a dice game comprising a multi-level bonus game having six bonus prize levels consisting of: (1) pair of ones ("snake eyes") (2) pair of twos, (3) pair of threes, (4) pair of fours, (5) pair of fives, and (6) pair of sixes. Satisfaction of one of these bonus prize levels increments the bonus prize to the next highest level, and wherein one of the events, such as a pair of sixes (6-6) may be optionally enabled to satisfy any of the previous levels. Such dice game may comprise an independent basic wagering game or may advantageously be incorporated into an ancillary game (e.g., a bonus game), such as is disclosed in co-pending U.S. patent application Ser. No. 10/427,657, titled "Gaming Machine With Board Game Theme" filed on Apr. 30, 2003, which is incorporated by reference herein.

As noted above, the ancillary game may comprise a game other than a bonus game and may include any ancillary game having an award of some form. The present concepts include, for example, a method of playing a wagering game having a basic game and an ancillary game including at least one award, wherein a plurality of players play at a plurality of gaming terminals. The method includes the steps of conducting the basic game at a first gaming terminal, fulfilling an ancillary game entry event at the first gaming terminal, and satisfying, at the first gaming terminal during an ancillary game, an ancillary game award-unlocking event to unlock an ancillary game award. This method also includes satisfying, at any of the plurality of gaming terminals, an award-win event subsequent to the ancillary game award-unlocking event to win an ancillary game award and awarding an ancillary game award to a player satisfying the ancillary game award-win event.

Likewise, the present concepts include a gaming system comprising a plurality of gaming terminals having at least one display, at least one data input device, at least one wager input device, and at least one communication device, each terminal being configured to run a wagering game and an ancillary game and a communications network linking the plurality of gaming terminals through the communication device of each gaming terminal. In this system, the wagering game comprises a device by which a player at a gaming terminal may enter an ancillary game and includes an award-unlocking event which, when satisfied by any of the players at any of the plurality of gaming terminals, unlocks the ancillary game award for winning by any player upon satisfaction of an award-win event.

In one aspect in accord with the present aspects, a method of playing a wagering game having a basic game, a bonus game including a plurality of successive bonus prizes, and a plurality of players playing at a plurality of gaming terminals, includes the acts of conducting the basic game at a first gaming terminal (A200) and fulfilling a bonus game entry event at the first gaming terminal (A210). The method further includes the acts of satisfying, at the first gaming terminal during a bonus game, a bonus prize unlocking event to unlock a bonus prize (A220) and satisfying, at any of the plurality of gaming terminals, a bonus prize win event subsequent to the bonus prize unlocking event (A230). In act A230, the satisfying of the bonus prize win event may occur at any of the plurality of gaming terminals, inclusive of the first gaming terminal. The method further includes the act of awarding a bonus prize to a machine (i.e., player) satisfying the bonus prize win event (A240).

Each of these embodiments and obvious variations thereof is contemplated as falling within the spirit and scope of the claimed invention, which is set forth in the following claims.

What is claimed is:

1. A method of conducting a wagering game, the wagering game having a basic game and a bonus game including a plurality of successive bonus prizes, the method including a plurality of players playing the bonus game at a plurality of gaming terminals, the method comprising the acts of:

locking a bonus prize available to any of the plurality of gaming terminals;

conducting the basic game at a first gaming terminal;

fulfilling a bonus game entry event at the first gaming terminal;

satisfying, at the first gaming terminal during the bonus game, a bonus prize unlocking event to unlock a bonus prize of a multi-level bonus prize in the bonus game, the multi-level bonus prize comprising a tiered plurality of different bonus prizes, the values of the plurality of different bonus prizes increasing in value with increased tier position;

satisfying, at any of the plurality of gaming terminals, a bonus prize win event in a turn during the bonus game subsequent to a turn comprising the bonus prize unlocking event;

awarding the bonus prize to a player satisfying the bonus prize win event in the bonus game; and incrementing the bonus prize of the multi-level bonus prize to a successive tier of the multi-level bonus prize, the successive bonus prize comprising a base tier if the awarded bonus prize to the player satisfying the bonus prize win event in the bonus game a top tier.

2. The method of conducting a wagering game in accord with claim 1, wherein the act of satisfying, at the first gaming terminal during the bonus game, the bonus prize unlocking event to unlock a bonus prize comprises satisfying a first outcome associated with the bonus prize unlocking event, wherein the act of satisfying, at any of the plurality of gaming terminals, the bonus prize win event in the turn during the bonus game subsequent to the turn comprising the bonus prize unlocking event comprises satisfying a second outcome associated with the bonus prize win event, and wherein the first outcome and the second outcome comprise identical outcomes.

3. The method of conducting a wagering game in accord with claim 2, wherein the first outcome satisfying the bonus prize unlocking event comprises moving a first game piece on a game board to a first game board square having a locked bonus prize and the second outcome satisfying the bonus prize win event comprises moving the first game piece or a second game piece on the game board to the first game board square in a turn subsequent to the bonus prize unlocking event.

4. The method of playing a conducting game in accord with claim 1, wherein a player satisfying a bonus prize unlocking event receives, at the time of such satisfying event, a predetermined award other than the bonus prize.

5. The method of playing a conducting game in accord with claim 1, wherein the fulfilling a bonus game entry event at the first gaming terminal comprises orientation of reel symbols in at least one predetermined arrangement.

6. The method of playing a conducting game in accord with claim 5, wherein the fulfilling a bonus game entry event at the first gaming terminal comprises orientation of reel symbols in at least one predetermined arrangement along a pay-line that has been activated by a wager input.

7. The method of conducting a wagering game in accord with claim 1, wherein the satisfying of the bonus prize win event comprises orientation of reel symbols in the bonus game in at least one predetermined arrangement.

8. The method of conducting a wagering game in accord with claim 1, wherein the satisfying of the bonus prize unlocking event to unlock a bonus prize of a multi-level bonus prize in the bonus game comprises moving a game piece on a game board to a game board square having a locked bonus prize, and wherein the satisfying of the bonus prize win event comprises moving a game piece on the game board to the game board square having the unlocked bonus prize.

9. A gaming terminal controlled by a game control system and being configured to play a wagering game, comprising:

an input device configured to receive inputs from a player during the wagering game, the inputs including a wager amount; and a display configured to display a randomly selected outcome of the wagering game in response to receiving the wager amount from the player;

wherein, in response to satisfaction of a bonus game entry condition, the game control system permits entry of the player into an ancillary game comprising a game board having a plurality of spaces traversable by one or more game elements, a plurality of the spaces on the game board being associated with a plurality of bonus games in the ancillary game, each of the plurality of bonus games comprising a plurality of levels, each successive level being associated with a value higher than the preceding levels, wherein the game control system generates a random number within a predetermined range of numbers and advances said game element a number of spaces on the game board corresponding to the random number to occupy a space on the game board corresponding to one of the plurality of said bonus games, and wherein said occupying of one of the plurality of spaces on the game board associated with the plurality of bonus games satisfies a bonus prize unlocking event to award to the player a bonus prize corresponding to a current level of the plurality of levels and to increment the current level for the associated space on the game board to a successive level of the plurality of levels.

10. A gaming system comprising a plurality of wagering game terminals configured to conduct a base wagering game and a community bonus game, comprising:

at least one display for displaying the community bonus game;

a game controller configured, upon execution of instructions corresponding to the community bonus game and determination of eligibility of a plurality of wagering game terminals, to perform the acts of presenting a plurality of elements on at least one display, at least one of the plurality of elements being associated with a community event multi-level bonus having a plurality of levels;

satisfying, at any of the plurality of gaming terminals, a community event bonus prize unlocking event to unlock a first level of the community event multi-level bonus, the first level being associated with a first award;

satisfying, at any of the plurality of gaming terminals, a community event bonus prize win event subsequent to the community event bonus prize unlocking event;

awarding the first award of the community event multi-level bonus to a player satisfying the community event bonus prize win event; and incrementing the community event multi-level bonus to a second level of the community event multi-level bonus, the second level being associated with a second award greater than the first award.

11. The gaming system according to claim 10, wherein the game controller is configured to further perform the act of decrementing the community event multi-level bonus to the first level of the community event multi-level bonus responsive to an awarding of an award associated with the highest level of the community event multi-level bonus.

12. A method of conducting a wagering game, the wagering game having a basic game and a bonus game including a plurality of successive bonus levels, the method including a plurality of players playing at a plurality of gaming terminals, the method comprising the acts of:

providing a community bonus game in which eligible ones of the plurality of players playing at the plurality of gaming terminals participate;

obtaining, at one of the gaming terminals during the community bonus game, a first outcome in the community bonus game associated with a bonus prize unlocking event to unlock a bonus prize of the plurality of successive bonus levels;

obtaining, at the one of the gaming terminals or any other one of the gaming terminals, a second outcome in the community bonus game associated with a bonus prize win event in a turn during the bonus game subsequent to the bonus prize unlocking event; and awarding the bonus prize to a player satisfying the bonus prize win event.

13. The method of conducting a wagering game in accord with claim 12, wherein the first outcome and the second outcome are the same.

14. The method of conducting a wagering game in accord with claim 12, wherein the occurrence of the bonus prize unlocking event in the community bonus game causes the bonus level to increment from a first level of the plurality of successive bonus levels to a second level of the plurality of successive bonus levels.

15. The method of conducting a wagering game in accord with claim 14, wherein the second level is greater than the first level.

16. The method of conducting a wagering game in accord with claim 12, wherein the player of the gaming terminal satisfying the bonus prize unlocking event in the community bonus game receives an award other than the bonus prize.

17. The method of conducting a wagering game in accord with claim 12, wherein the community bonus game comprises a plurality of different community bonus games that are simultaneously presented.

18. The method of conducting a wagering game in accord with claim 17, wherein the plurality of community bonus games are simultaneously presented to the players in a unified gaming environment.

19. The method of conducting a wagering game in accord with claim 17, wherein the plurality of community bonus games each comprises a bonus game having a plurality of successive bonus levels, and wherein the occurrence of the bonus prize unlocking event for a particular one of the plurality of community bonus games causes the bonus level of that particular one of the plurality of community bonus games to increment from a first level of the plurality of successive bonus levels to a second level of the plurality of successive bonus levels.

20. The method of conducting a wagering game in accord with claim 19, wherein the occurrence of the bonus prize unlocking event, when the bonus prize is at the highest level of the plurality of successive bonus levels, causes bonus level to increment to a default level of the plurality of successive bonus levels.

21. The method of conducting a wagering game in accord with claim 14, wherein, in the community bonus game, the obtaining of the first outcome in the community bonus game associated with a bonus prize unlocking event comprises moving a game piece on a game board to a game board square having a locked bonus prize, and wherein the obtaining, at the one of the gaming terminals or any other one of the gaming terminals, a second outcome in the community bonus game associated with a bonus prize win event comprises moving the game piece or another game piece on the game board to the game board square having the unlocked bonus prize.

22. A method of conducting a wagering game, the wagering game having a basic game and a bonus game including a bonus prize, the method comprising the acts of:

conducting a persistent-state bonus game via a first player at a first wagering game terminal;

satisfying a bonus prize unlocking event during the conduct of the persistent-state bonus game via the first wagering game terminal, the bonus prize unlocking event unlocking a bonus prize;

conducting the persistent-state bonus game via a second player at a second wagering game terminal;

satisfying a bonus prize win event, subsequent to the bonus prize unlocking event, during the conduct of the persistent-state bonus game via the second wagering game terminal; and awarding a bonus prize associated with the bonus prize win event to the second player at the second wagering game terminal.

23. The method of conducting a wagering game according to claim 22, wherein the bonus prize comprises a multi-level bonus prize having a plurality of tiers of bonus prizes each tier having a different value.

24. The method of conducting a wagering game according to claim 23, further comprising the act of:

incrementing the bonus prize of the multi-level bonus prize to a successive tier of the multi-level bonus prize following the satisfying of the bonus prize win event.

25. The method of conducting a wagering game according to claim 24, further comprising the act of:

resetting the bonus prize of the multi-level bonus prize to a lowest value tier subsequent to satisfying of the bonus prize win event for the bonus prize of the multi-level bonus prize having the highest value tier.

26. The method of conducting a wagering game according to claim 22, wherein the first wagering game terminal and the second wagering game terminal are the same wagering game terminal.

* * * * *